US006893275B2

(12) United States Patent
Ng et al.

(10) Patent No.: US 6,893,275 B2
(45) Date of Patent: May 17, 2005

(54) ELECTRICAL RECEPTACLE WITH SHUTTER

(75) Inventors: Kenneth Ng, Los Angeles, CA (US); Edmund Ng, Los Angeles, CA (US)

(73) Assignee: Koncept Technologies Inc., Monterey Park, CA (US)

( * ) Notice: Subject to any disclaimer, the term of this patent is extended or adjusted under 35 U.S.C. 154(b) by 0 days.

(21) Appl. No.: 10/374,503

(22) Filed: Feb. 26, 2003

(65) Prior Publication Data

US 2004/0147148 A1 Jul. 29, 2004

Related U.S. Application Data

(63) Continuation of application No. 10/354,949, filed on Jan. 29, 2003.

(51) Int. Cl.[7] ..... H01R 13/44
(52) U.S. Cl. ..... 439/137; 439/140
(58) Field of Search ..... 439/137–145

(56) References Cited

U.S. PATENT DOCUMENTS 3,222,631 A 12/1965 Cohen
4,379,607 A 4/1983 Bowden, Jr.
4,707,042 A 11/1987 Haden
4,722,693 A 2/1988 Rose
4,867,693 A * 9/1989 Gizienski et al. ..... 439/137
4,867,694 A * 9/1989 Short ..... 939/137
5,020,997 A 6/1991 Calderara et al.
5,624,270 A 4/1997 Blanchot et al.
5,702,259 A 12/1997 Lee
5,915,981 A 6/1999 Mehta
6,086,391 A 7/2000 Chiu
6,422,880 B1 7/2002 Chiu

FOREIGN PATENT DOCUMENTS

GB 2199996 * 7/1988 ..... H01R/13/453

* cited by examiner

*Primary Examiner*—Chandrika Prasad
(74) *Attorney, Agent, or Firm*—Foley & Lardner LLP

(57) ABSTRACT

A shutter assembly for a receptacle. The shutter assembly may include a first plate, a second plate disposed adjacent the first plate, a shutter disposed between the first plate and the second plate, a first spring that provides lateral movement of the shutter, a second spring that provides transverse movement of the shutter and a plunger for providing a pivot point to the shutter. The plunger may be disposed between the second spring and the shutter. According to an embodiment of the invention, when there are no pins or there is one pin inserted into the shutter assembly, the shutter is in a first position and lugs on the shutter abut locks disposed on the first plate and the second plate, thereby barring access to apertures in the assembly. When two pins, other than the ground pin, either sharp or round edges, are inserted into the shutter assembly, the shutter slides laterally to expose apertures in the assembly, making the receptacle available for use.

51 Claims, 21 Drawing Sheets

ELECTRICAL RECEPTACLE WITH SHUTTER

CROSS-REFERENCE TO RELATED APPLICATIONS

This application is a continuation of an application entitled "Shutter Assembly for Receptacle," Ser. No. 10/354,949 filed Jan. 29, 2003, from which priority is claimed and the contents of which are hereby incorporated herein by reference.

BACKGROUND

The present invention relates to shutter assemblies for receptacles and, in particular, to shutter assemblies that may prevent access to common household AC outlets.

Virtually every household in the industrialized world is equipped with sockets, outlets or receptacles supplying electrical power. Electrical power is generally considered a necessity and, thus, virtually no modern home is ever designed without access to electrical power. Also, with the rapid increase in the number of electrical and electronic products in a typical home, power strips employing multiple power outlets have become commonplace, resulting in an increase in the number of electrical power outlets in the typical, modern home.

In addition, the increase in the number of electrical and electronic products in the typical home has increased not only the number of power outlets in the home, but also the number of electronic sockets and receptacles generally. Computers, stereo equipment, DVD players, television sets and the like are replete with plugs, pins, receptacles and sockets that must mate for effective operation of the equipment.

The natural curiosity of children can make the common household power outlet a dangerous device. Although children may not likely insert a standard three-prong plug of an electrical device into a wall outlet, it is not uncommon for a child to insert a single metal object, such as, for example, a key or a paper clip, into a wall outlet. Given the high voltage that typically exists in a common AC power outlet, such a scenario could be dangerous or even deadly. When children attempt to insert metal objects into computer or entertainment equipment receptacles, damage to the device may result.

Several attempts have been made in the prior art to preclude unwanted insertion of objects into power outlets. Some prior art devices employ a shutter plate that locks when a single pin is inserted into the outlet. However, in these devices, the normal position of the shutter plate is in an unlocked position. Thus, by carefully inserting a pin into the outlet, or by just being lucky (or, more accurately, unlucky), the shutter plate may be subverted and the safety of the device compromised.

Other prior art devices have employed multiple shutters to prevent unwanted access to power outlets. However, in electrical sockets, the distance between the front surface of the socket to the electrical contact inside the socket is limited. Thus, multiple shutters must share this limited space, and performance may be compromised. In addition, because multiple shutters of some prior art devices have relatively large contact surfaces, relatively large amounts of friction are generated when the shutters slide as a result of plugs being inserted into the socket and against the contact surfaces. As a result, the contact surfaces and other surfaces can wear out quickly, especially when plugs with relatively sharp edges are inserted into the socket.

SUMMARY

It is therefore an object of the present invention to provide a shutter assembly that prevents unwanted, undesired or improper access to receptacles.

It is another object of the present invention to provide a shutter assembly that prevents unwanted, undesired or improper insertion of a single pin into an AC voltage outlet.

According to embodiments of the present invention, a shutter assembly for a receptacle may include a first plate, a second plate disposed adjacent the first plate, a shutter disposed between the first plate and the second plate, a first spring for providing lateral movement of the shutter, the first spring abutting a first extension of the first plate; a second spring for providing transverse movement of the shutter; and a plunger for providing a pivot point to the shutter, the plunger disposed between the second spring and the shutter. The receptacle may be an AC outlet.

According to an embodiment of the present invention, the first plate and the second plate may include a plurality of apertures for accepting pins. The pins may be AC plug pins.

The shutter may include a first angled surface, a second angled surface; and an aperture, the aperture disposed between the first angled surface and the second angled surface. In a first position of the shutter, the first angled surface may be aligned with one of the plurality of apertures of the first plate and the second angled surface may be aligned with another of the plurality of apertures of the first plate.

The first plate may further include a first lock and a second lock and the second plate may further include a third lock and a fourth lock. The shutter may further include a first lug, a second lug, a third lug and a fourth lug. When the shutter is in the first position, the first lug may abut the first lock of the first plate and the second lug may abut the second lock of the first plate.

In a second position of the shutter, the aperture of the shutter may align with one of the plurality of apertures of the first plate and one of the plurality of apertures of the second plate as pins are inserted through at least two of the plurality of apertures of the first plate, the pins being simultaneously inserted against the first angled surface and the second angled surface. The shutter may compress the first spring when the shutter is in the second position. The second spring may cause the first lug and the second lug to abut the first lock and the second lock when the shutter is in the first position.

The shutter may pivot about the plunger when one pin is inserted into one of the plurality of apertures of the first plate. The first lug may abut the first lock when the shutter pivots about the plunger. The second lug may abut the second lock when the shutter pivots about the plunger. The third lug may abut the third lock when the shutter pivots about the plunger. The fourth lug may abut the fourth lock when the shutter pivots about the plunger.

The shutter may cover the plurality of apertures of the first plate and the second plate when the shutter is in the first position. The shutter may remain in the first position when only one pin is inserted through an aperture in the first plate.

The second spring may include two springs. The first lock and the second lock may be protrusions of the first plate. The first lock and the second lock may be attached to the first plate. The third lock and the fourth lock may be a protrusion of the second plate. The third lock and the fourth lock may attach to the second plate. The second plate may further include a first compartment for housing the plunger and a second compartment for housing the second spring.

According to other embodiments of the present invention, a shutter assembly for a receptacle may include a first plate, a second plate disposed adjacent the first plate, a shutter disposed between the first plate and the second plate, a first spring for providing lateral movement of the shutter, the first spring abutting a first side of the shutter; a second spring for providing transverse movement of the shutter; and a plunger for providing a pivot point to the shutter, the plunger disposed between the second spring and the shutter. The receptacle may be an AC outlet.

According to another embodiment of the present invention, the first plate and the second plate may include a plurality of apertures for accepting pins. The pins may be AC plug pins.

The shutter may include a first angled surface, a second angled surface; and an aperture, the aperture disposed between the first angled surface and the second angled surface. In a first position of the shutter, the first angled surface may be aligned with one of the plurality of apertures of the first plate and the second angled surface may be aligned with another of the plurality of apertures of the first plate.

The first plate may further include a first lock and a second lock and the second plate may further include a third lock. The shutter may further include a first lug, a second lug. When the shutter is in the first position, the first lug may abut the first lock of the first plate and the second lug may abut the second lock of the first plate.

In a second position of the shutter, the aperture of the shutter may align with one of the plurality of apertures of the first plate and one of the plurality of apertures of the second plate as pins are inserted through at least two of the plurality of apertures of the first plate, the pins being simultaneously inserted against the first angled surface and the second angled surface. The shutter may compress the first spring when the shutter is in the second position. The second spring may cause the first lug and the second lug to abut the first lock and the second lock when the shutter is in the first position.

The shutter may pivot about the plunger when one pin is inserted into one of the plurality of apertures of the first plate. The first lug may abut the first lock when the shutter pivots about the plunger. The second lug may abut the second lock when the shutter pivots about the plunger. A portion of the shutter may abut the third lock when the shutter pivots about the plunger.

DETAILED DESCRIPTION

In the following description of preferred embodiments, reference is made to the accompanying drawings which form a part hereof and in which are shown by way of illustration specific embodiments in which the invention may be practiced. It is to be understood that other embodiments may be utilized and structural changes may be made without departing from the scope of the preferred embodiments of the present invention.

Although the following description is directed primarily to an AC voltage outlet commonly found in homes and offices, shutter assemblies according to embodiments of the present invention may be used in any receptacle for which the prevention of unwanted or improper access is desired. For example, shutter assemblies according to embodiments of the present invention may be used in receptacles in electrical or electronic equipment such as computers, stereo equipment, DVD players, VCRs, musical equipment and the like.

Figure 1:
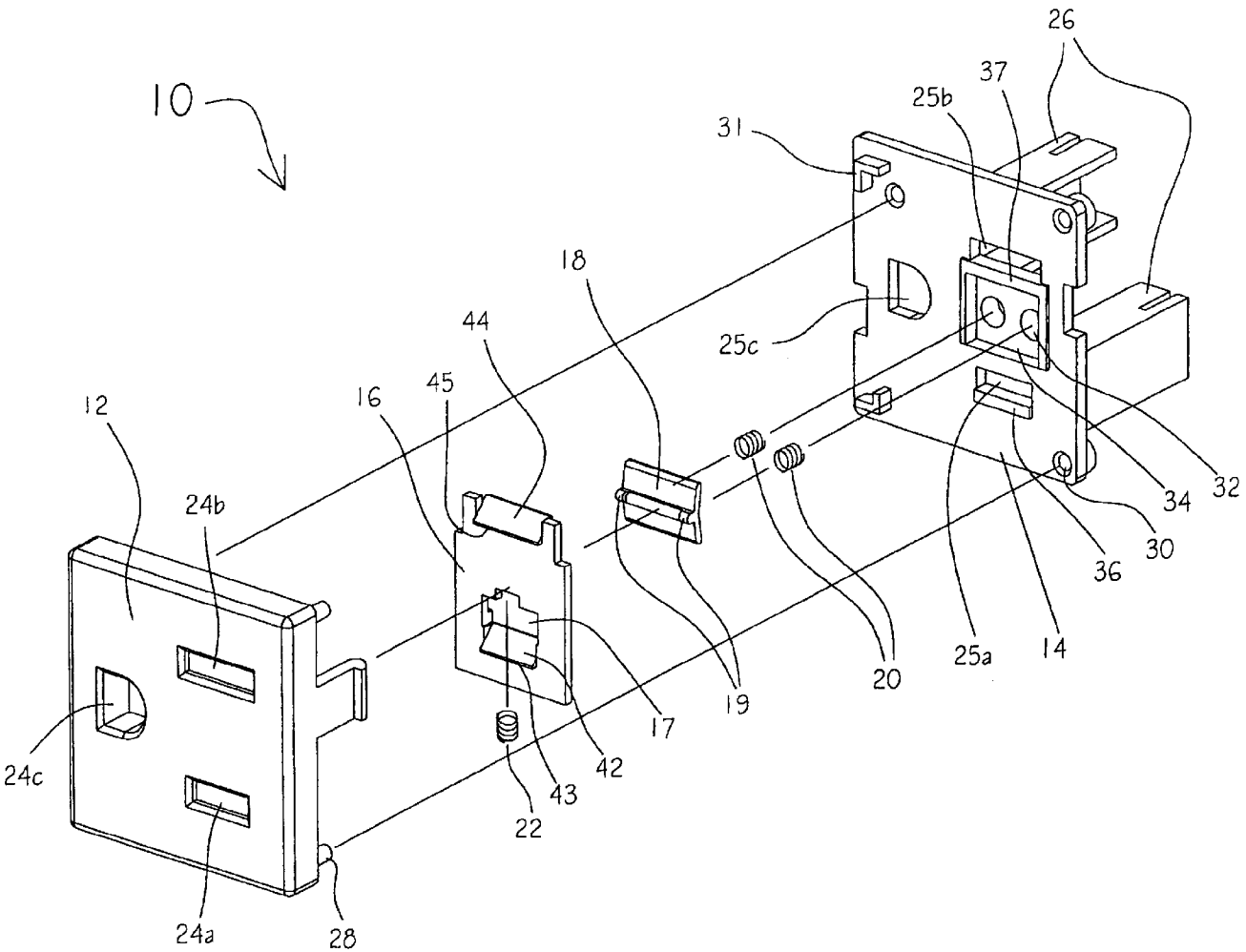
FIG. 1 shows a perspective view of a shutter assembly according to an embodiment of the present invention.
Figure 2:
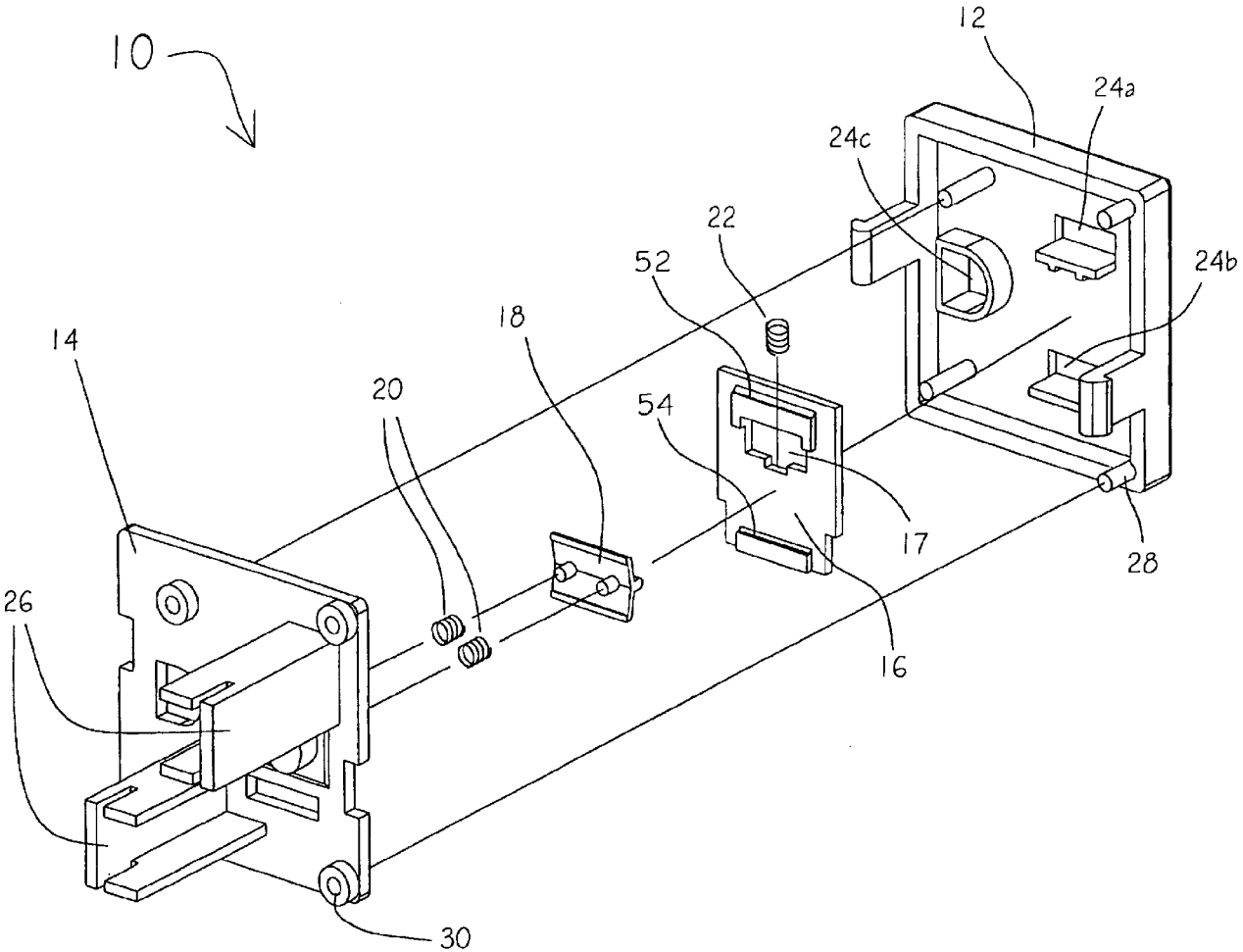
FIG. 2 shows a perspective view of a shutter assembly according to an embodiment of the present invention.

A shutter assembly 10 according to an embodiment of the present invention is shown in FIGS. 1 and 2. The shutter assembly 10 includes a front plate 12, a back plate 14, a shutter 16, a plunger 18, one or more plunger springs 20 and a shutter spring 22. According to the embodiment of the present invention shown in FIGS. 1 and 2, the shutter assembly 10 is used for a common household AC outlet.

According to the embodiment of the invention shown in FIGS. 1 and 2, the front plate 12 includes front plate apertures 24*a*, 24*b* and 24*c*. The front plate apertures 24*a*, 24*b* and 24*c* shown in the embodiment of the invention of FIGS. 1 and 2 are configured to accept a standard two-prong AC plug and a standard three-prong AC plug. However, embodiments of the invention may have front plate socket apertures configured in a variety of ways. For example, the front plate socket apertures may be configured to accept a standard two-prong AC plug, to conform to the characteristics of AC plugs in any country, or to accept the plugs of any type of cable used in a variety of industries. The front plate apertures may be configured to accept computer plugs, musical equipment plugs and the like.

The front plate 12 also includes one or more shafts 28 that may be useful in adjoining the front plate 12 with the back plate 14. In addition, the front plate 12 may include a variety of shafts, pins or brackets that may correspond to guides on the back plate 14, all of which may by used to maintain the position of the shutter 16 when the shutter 16 is disposed between the front plate 12 and the back plate 14.

The front plate 12 may also include a first front plate extension 23*a* and a second front plate extension 23*b*. The shutter spring 22 may be disposed between the first front plate extension 23*a* and the second front plate extension 23*b* and may abut the first front plate extension 23*a*.

According to an embodiment of the present invention, the back plate 14 includes back plate apertures 25*a*, 25*b* and 25*c*. The back plate apertures 25*a*, 25*b* and 25*c* of the embodiment of the invention shown in FIG. 1 align with the front plate apertures 24*a*, 24*b* and 24*c* and are also configured to conform to a standard three-prong AC plug. The back plate 14 also includes one or more shaft guides 30 that serve as a receptacle for the shafts 28 of the front plate 12 when adjoining the front plate 12 and the back plate 14. The back plate 14 also includes mounts 26 that aid in holding the metal contacts behind the socket outlet. Brackets 31 may also be used for alignment when adjoining the front plate 12 to the back plate 14.

The back plate 14 may also include one or more plunger spring compartments 32 and a plunger compartment 34. The one or more plunger spring compartments 32 may be used to provide a place for disposing the one or more plunger springs 20. The plunger compartment 34 may be used to provide a place within the back plate 14 for disposing the plunger 18.

The back plate 14 may also include one or more back plate locks 36, 37 that aid in securing the shutter when undesired, unwanted or improper access to the receptacle is attempted.

The shutter 16 may include a first angled surface 2 and a second angled surface 44. At one end of the first angled surface 42 is a first lug 4 and at the other end of the first angled surface 42 is a third lug 52. Similarly, at one end of the second angled surface 44 is a second lug 45 and at the other end of the second angled surface 44 is a fourth lug 54. In the embodiment of the invention shown in FIGS. 1 and 2, the lugs 43 and 52 form an integral part of the first angled surface 42, the lugs 45 and 54 form an integral part of the second angled surface 44. However, the lugs 43, 45, 52, 54 need not be so formed. The lugs 43, 45, 52, 54 may be formed as another part of the shutter 16 or may be separate parts that are attached or affixed to the shutter 16.

The first angled surface 42 and the second angled surface 44 may be fabricated at a variety of angles. According to embodiments of the present invention, the angle of the first angled surface 42 and the second angled surface 44 may be greater than 45°. According to one embodiment of the present invention, the angle of the first angled surface and the second angled surface may be 47°. Angles of 45° or greater provide for minimal wear on the first angled surface 42 and the second angled surface 44 when pins or plugs are inserted into the shutter assembly 10 and up against the first angled surface 42 and the second angled surface 44.

The shutter 16 also includes at least one shutter aperture 17. The shutter aperture 17 may align with the first front plate aperture 24*a* and the first back plate aperture 25*a*, as will be explained in more detail below.

According to the embodiment of the invention shown in FIGS. 1 and 2, the plunger 18 is disposed between the back plate 14 and the shutter 16. The plunger 18 may also include one or more ridges 19 for providing a pivot point to the shutter 16. The ridge 19 may be formed in a triangular shape, a rounded shape, or any shape what will allow the shutter 16 to pivot about the ridge 19 while the ridge 19 is forced against one side of the shutter 16 due to the force applied by the plunger spring 20, as will be explained in more detail below.

Operation of the shutter assembly 10 when access to the receptacle is desired may be seen in FIGS. 3–6. In the embodiment of the invention shown in FIG. 3, the front plate 12 is disposed adjacent to and abuts the back plate 14. Disposed in a hollow area between the front plate 12 and the back plate 14 is the shutter 16. The plunger spring 20 is disposed in the plunger spring compartment 32 and is configured such that it exerts a force plunger 18, which itself is disposed between the plunger spring 20 and the shutter 16. In turn, the ridge 19 of the plunger 18 exerts a force against the shutter 16 due to the force exerted by the plunger spring 20. When there are no pins present within the shutter assembly 10, there is no force external to the shutter assembly 10 acting on the shutter 16. Thus, the shutter 16 is disposed against the front plate 12 due to the force acting on it exerted by the plunger spring 20 through the plunger 18 and the ridge 19.

Figure 3:
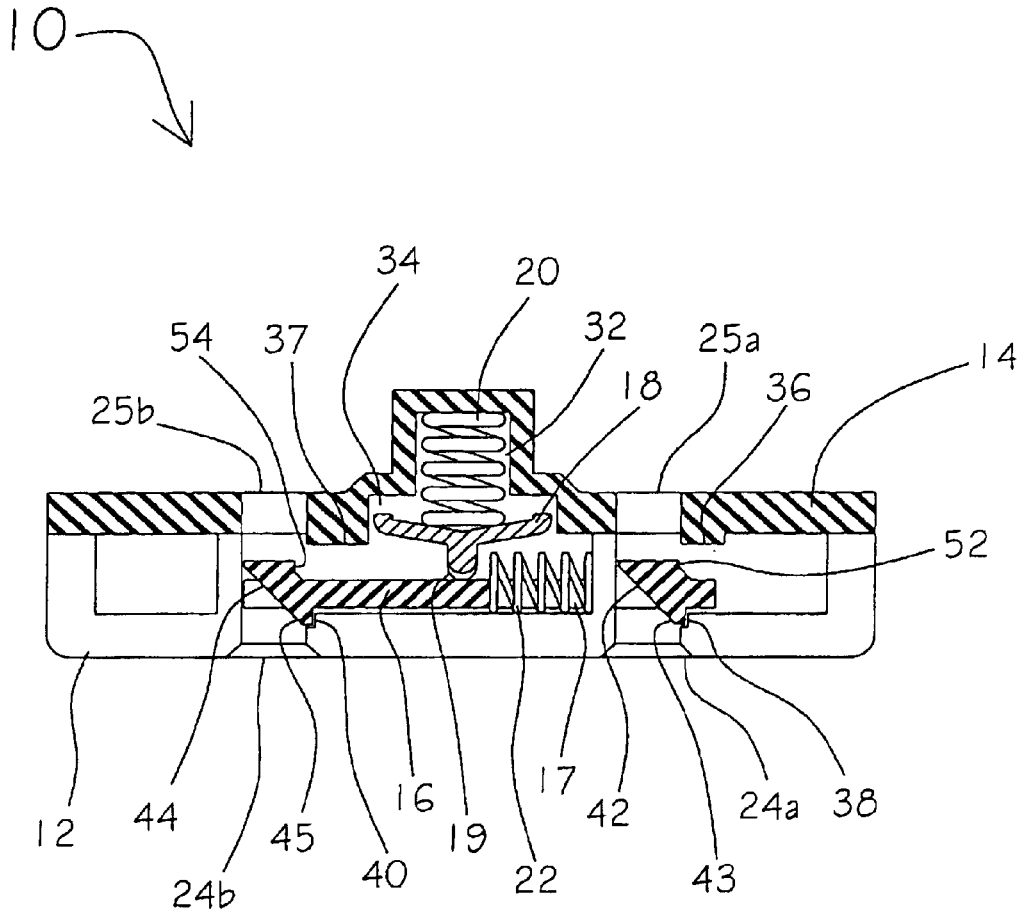
FIG. 3 shows a cutaway plan view of a shutter assembly according to an embodiment of the present invention.

When the shutter 16 is in the position shown in FIG. 3, the first lug 43 and the second lug 45 of the shutter 16 abut a first front plate lock 38 and a second front plate lock 40, respectively. The first front plate lock 38 and the second front plate lock 40 may be fabricated as an integral portion of the front plate 12. According to another embodiment of the present invention, the first front plate lock 38 and the second front plate lock 40 may be fabricated as separate parts that are affixed or otherwise attached to the front plate 12. As can be seen in FIG. 3, the first front plate lock 38 and the second front plate lock 40 provide resistance for the first lug 43 and the second lug 45, respectively, thereby preventing the shutter 16 from moving toward its open position.

Figure 4:
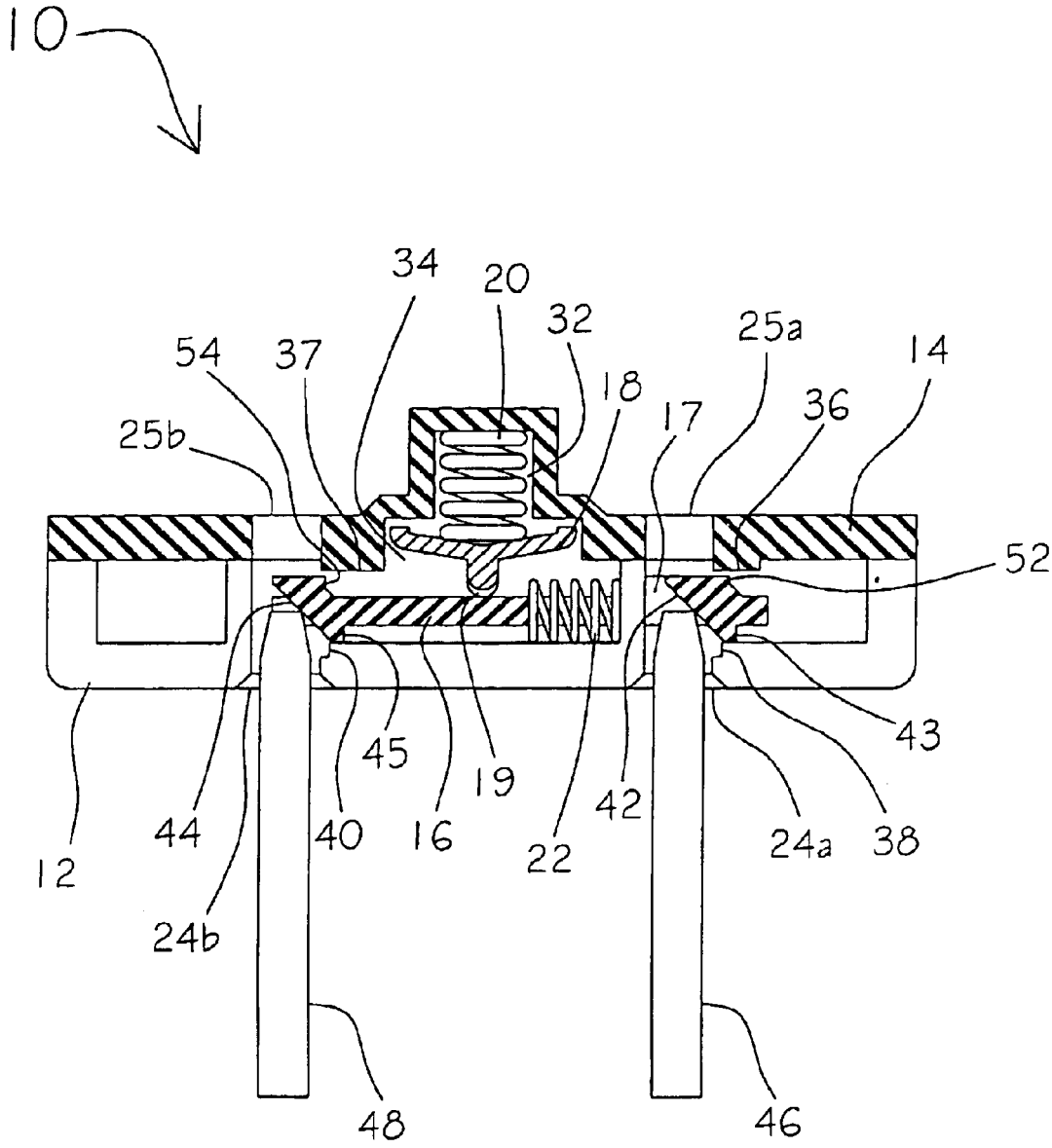
FIG. 4 shows a cutaway plan view of a shutter assembly with two pins inserted into the shutter assembly according to an embodiment of the present invention.

However, as can be seen in FIG. 4, if a substantially equal force is applied to the first pin 46 and the second pin 48, the first pin 46 and the second pin 48 will simultaneously push against the first angled surface 42 and the second angled surface 44, respectively. In so doing, the first lug 43 and the second lug 45 are pushed away from the first front plate lock 38 and the second front plate lock 40, respectively. When the positions of the first lug 43 and the second lug 45 are clear of the first front plate lock 38 and the second front plate lock 40, respectively, there is no resistance to the lateral movement of the shutter 16. Also, as the first pin 46 and the second pin 48 are inserted through the front plate apertures 24 and pushed against the first angled surface 42 and the second angled surface 44, respectively, the shutter 16, whose lateral movement is not inhibited by the first front plate lock 38 and the second front plate lock 40, moves toward its open position and, if adequate force is applied by the first pin 46 and the second pin 48, the compression of the shutter spring 22 increases as it is forced against the first front plate extension 23*a*.

Figure 5:
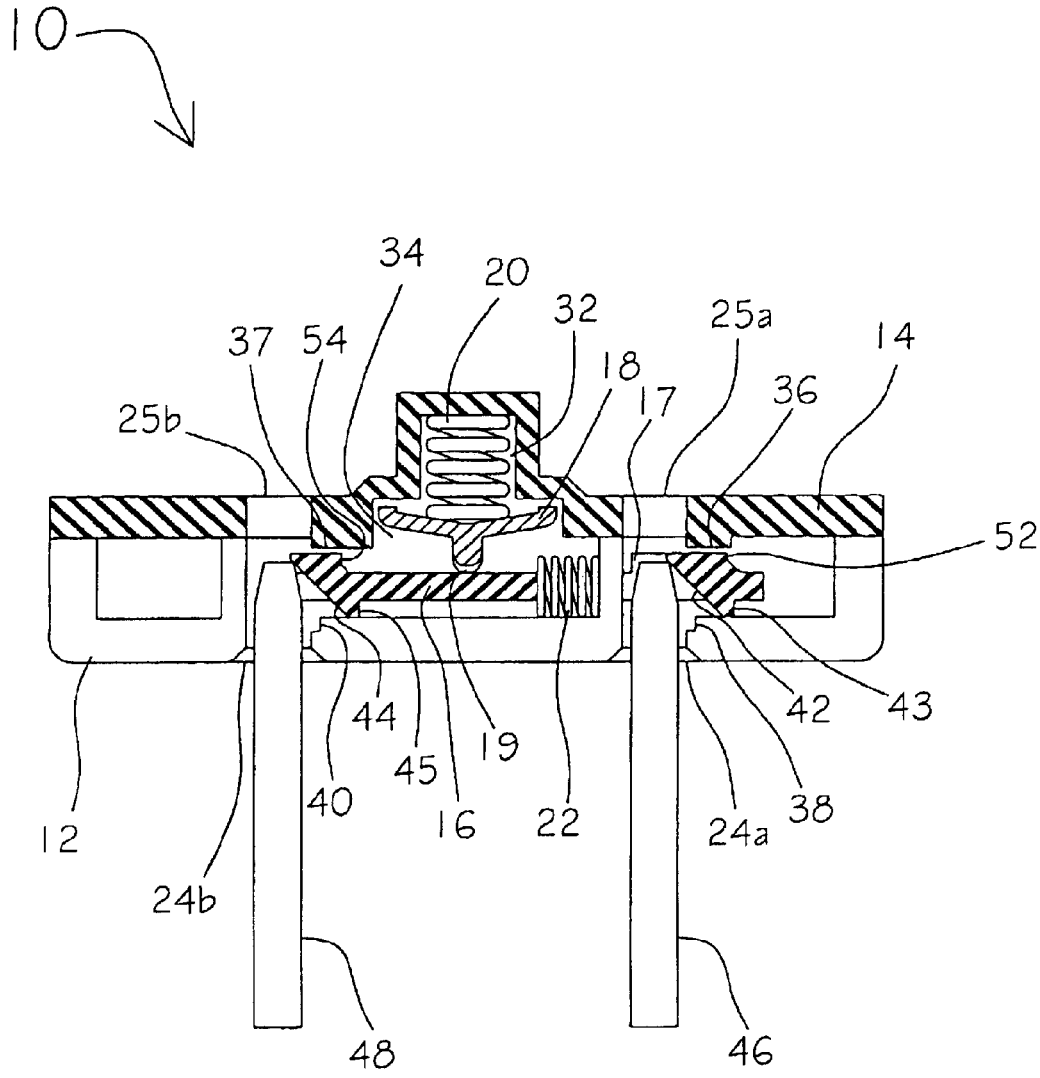
FIG. 5 shows a cutaway plan view of a shutter assembly with two pins inserted into the shutter assembly according to an embodiment of the present invention.
Figure 6:
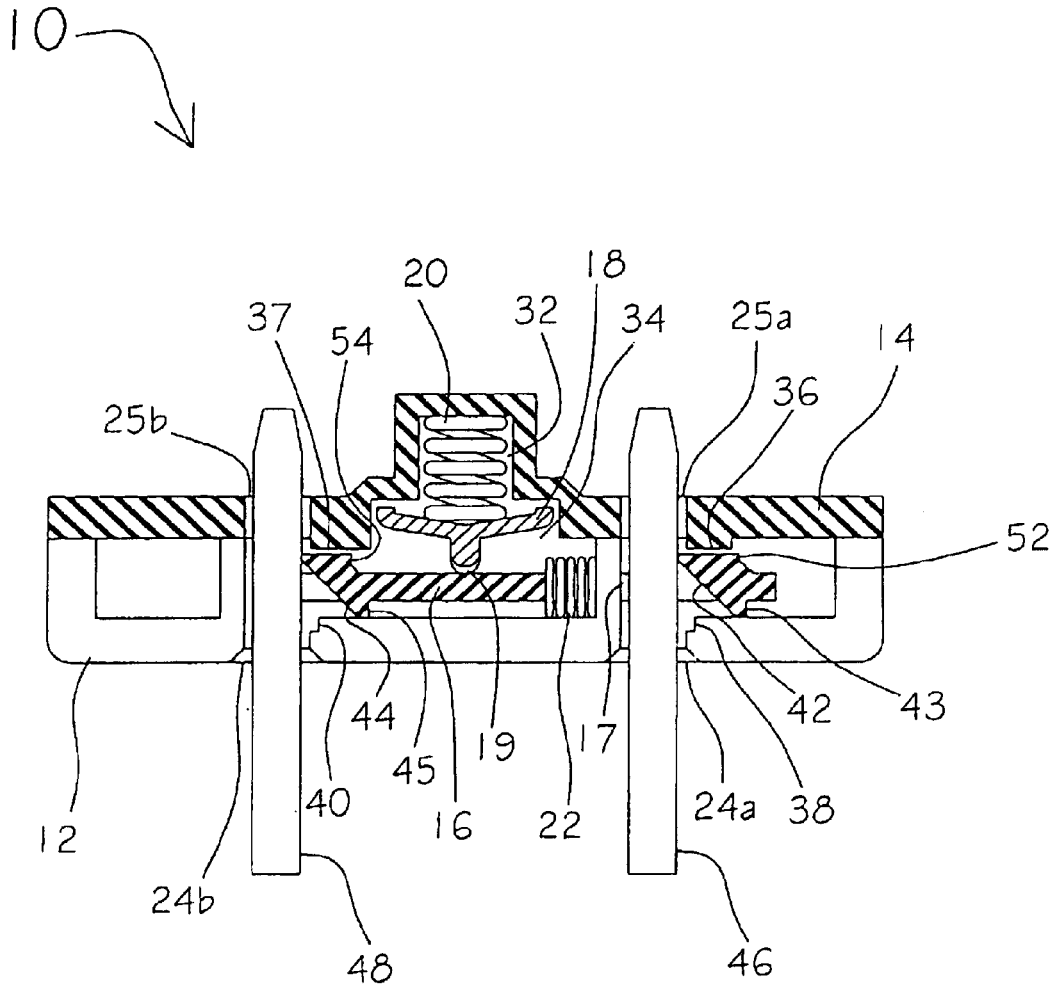
FIG. 6 shows a cutaway plan view of a shutter assembly with two pins inserted into the shutter assembly according to an embodiment of the present invention.

Moreover, as can be seen in FIG. 5, as the shutter 16 moves laterally toward its open position, the shutter aperture 17 aligns itself with the first front plate aperture 24*a* and the first back plate aperture 25*a* and, simultaneously, the second front plate aperture 24*b* and the second back plate aperture 25*b* through which the second pin 48 is being inserted are exposed. Thus, the first pin 46 is free to extend fully through the first front plate aperture 24*a*, the shutter aperture 17 and the first back plate aperture 25*a*, as may be seen n FIG. 6. Also, the second pin 48 is free to extend fully through the second front plate aperture 24*b* and the second back plate aperture 25*b*. In FIG. 6, the shutter spring 22 is compressed. When the first pin 46 and the second pin 48 are removed from the shutter assembly 10, the compression of the shutter spring 22 will force the shutter 16 back into its locked position as shown in FIG. 3.

Figure 7:
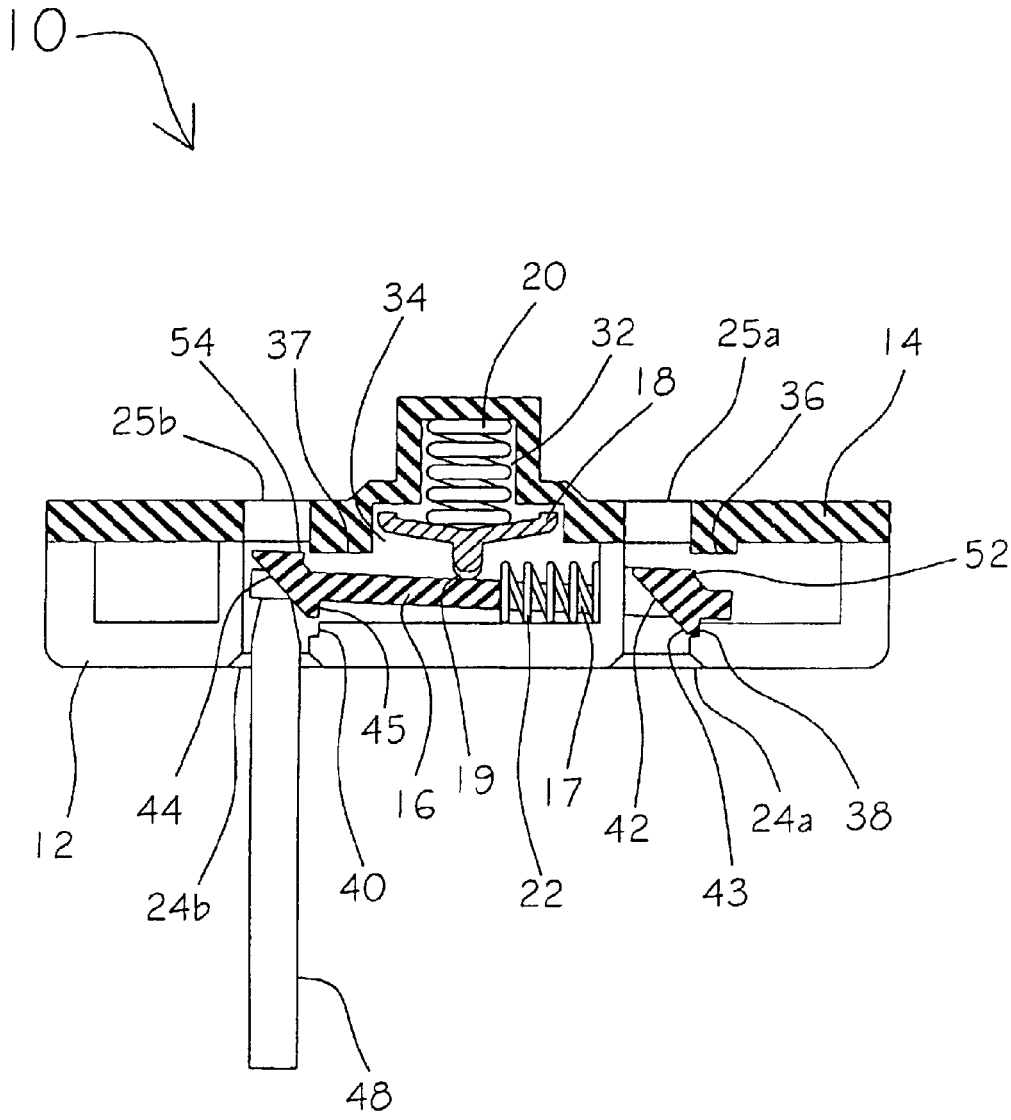
FIG. 7 shows a cutaway plan view of a shutter assembly with one pin inserted into the shutter assembly according to another embodiment of the present invention.
Figure 8:
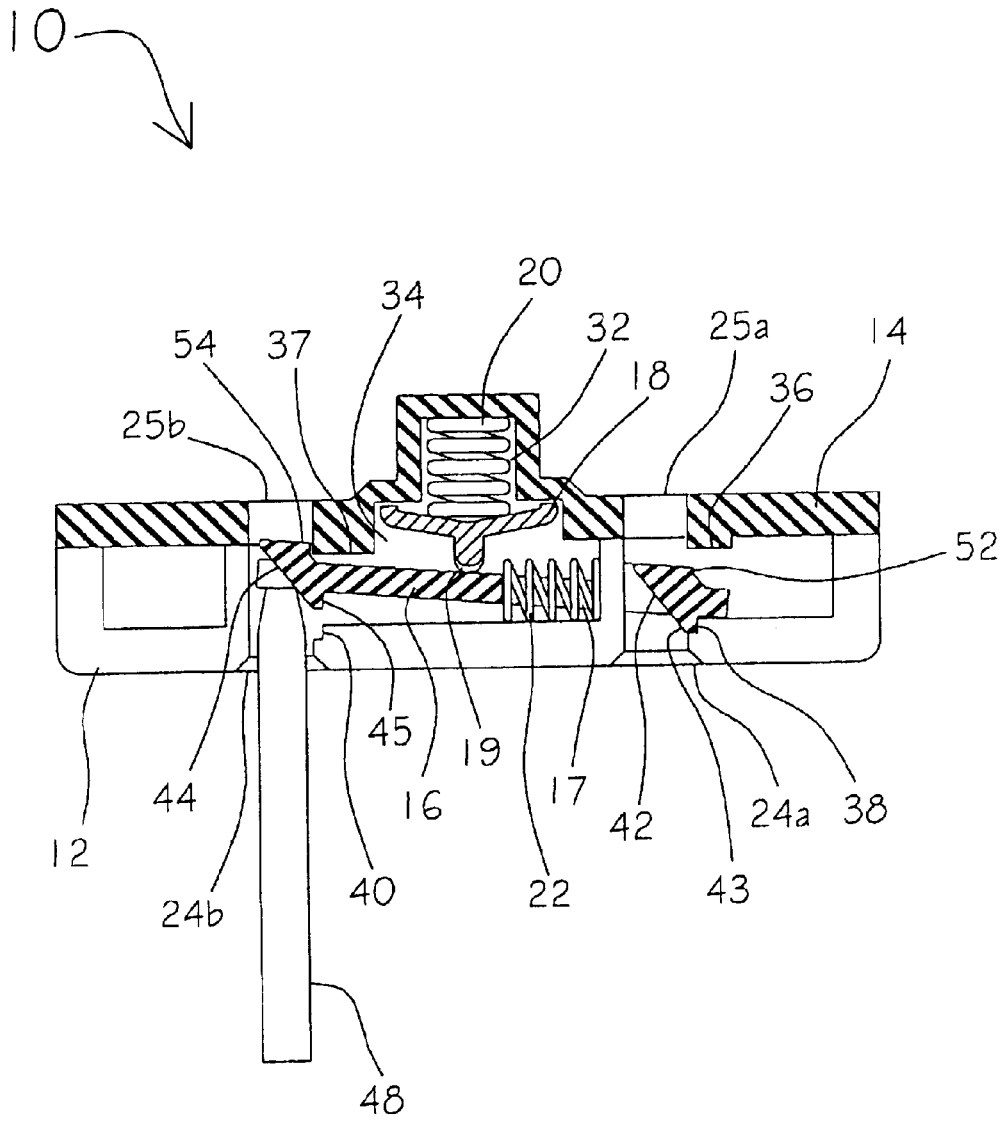
FIG. 8 shows a cutaway plan view of a shutter assembly with one pin inserted into the shutter assembly according to another embodiment of the present invention.

Operation of the shutter assembly 10 when entry into a receptacle is unwanted, undesired or improper may be seen in FIGS. 7, 8, 9, 10. In FIG. 7, the second pin 48 only is inserted into the second front plate aperture 24*b*. This situation may be reminiscent, for example, of a child trying to stick a key or other object into one of the apertures of an AC outlet. In FIG. 7, as the second pin 48 extends through the second front plate aperture 24*b*, the force exerted by the second pin 48 on the second angled surface 44 causes the shutter 16 to pivot about the ridge 19. Thus, although the second lug 45 is forced away from the second front plate lock 40, the first lug 43 is forced by the plunger to maintain its position against the first front plate lock 38. The fourth lug 54 is then forced to the position against the fourth lock 37 as seen in FIG. 8. Thus, the shutter 16 is prevented from moving laterally toward its open position, the first and second front plate apertures 24*a* and 24*b* are blocked by the shutter 16, and access to the first and second back plate apertures 25*a* and 25*b* and the receptacle itself is prevented.

Figure 9:
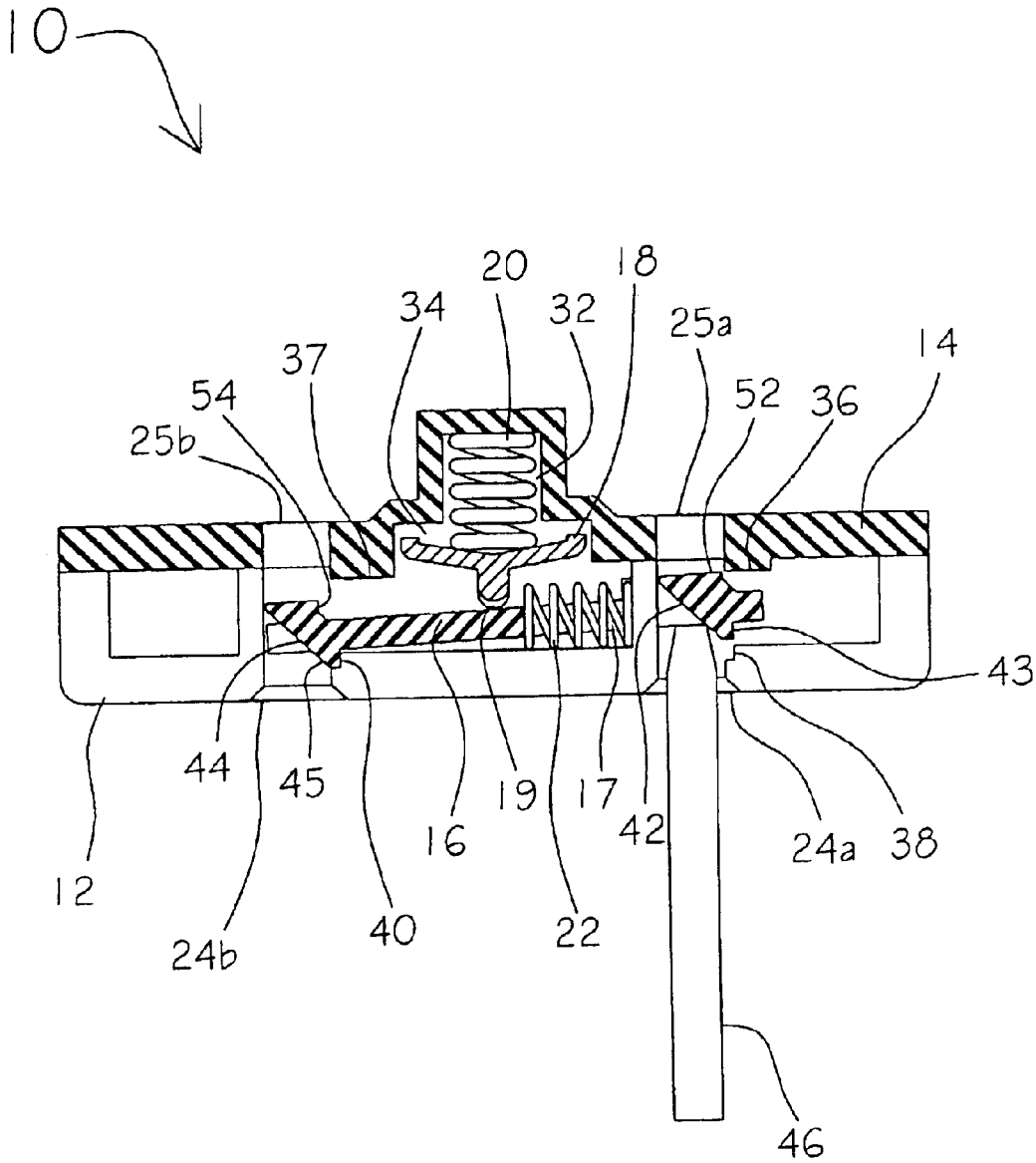
FIG. 9 shows a cutaway plan view of a shutter assembly with one pin inserted into the shutter assembly according to another embodiment of the present invention.
Figure 10:
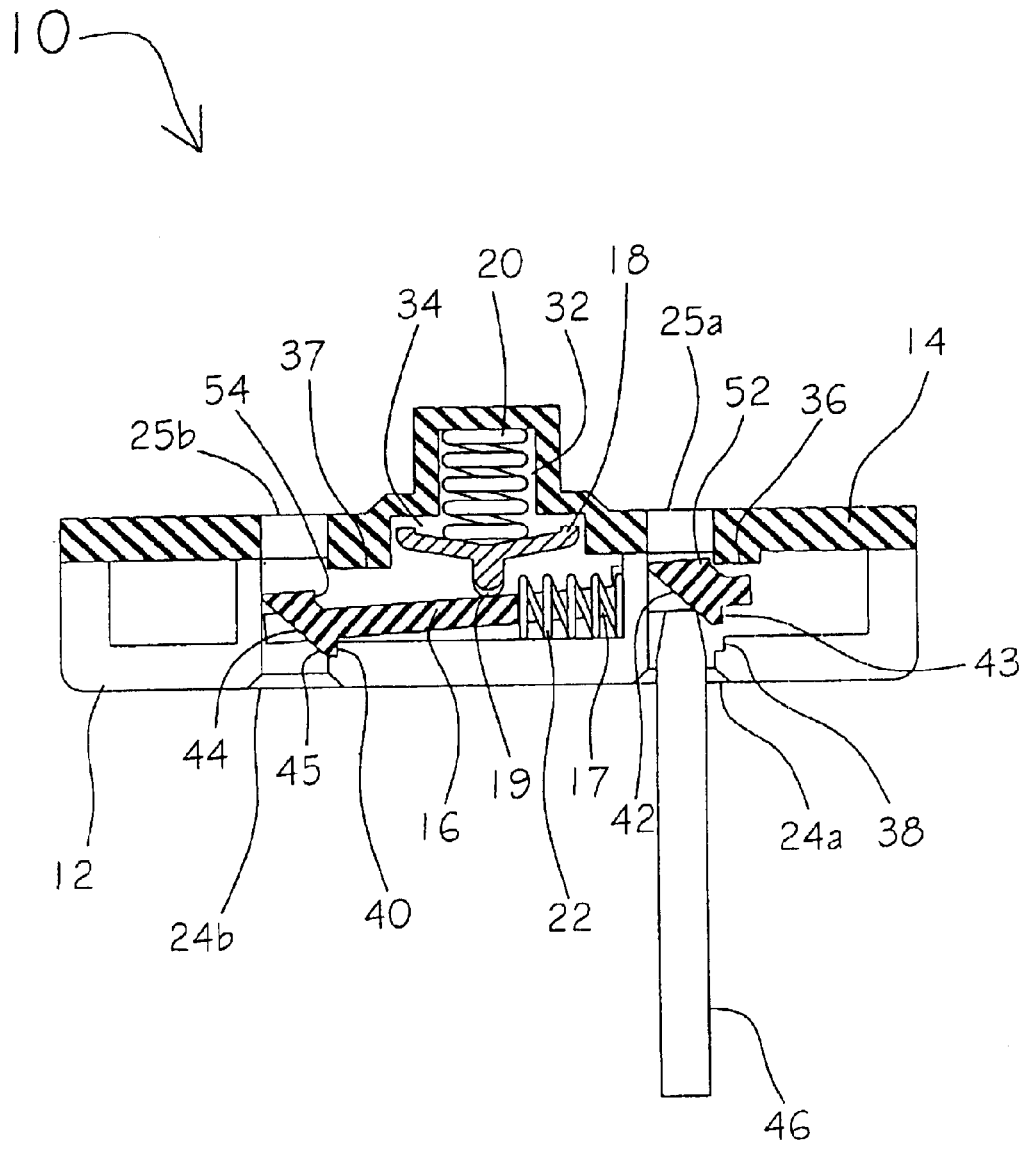
FIG. 10 shows a cutaway plan view of a shutter assembly with one pin inserted into the shutter assembly according to another embodiment of the present invention.

A similar operation may be seen in FIG. 9. In FIG. 9, the first pin 46 only is inserted into the first front plate aperture 24*a*. In FIG. 9, as the first pin 46 extends through the first front plate aperture 24*a*, the force exerted by the first pin 46 on the first angled surface 42 causes the shutter 16 to pivot about the ridge 19. Thus, although the first lug 43 is forced away from the first front plate lock 38, the second lug 45 is forced to maintain its position against the second front plate lock 40. The third lug 52 is then forced to the position against the third lock 36 as seen in FIG. 10. Thus, the shutter 16 is prevented from moving laterally toward its open position, the first and second front plate apertures 24*a* and 24*b* are blocked by the shutter 16, and access to the first and second back plate apertures 25*a* and 25*b* and the receptacle itself is prevented.

Figure 11:
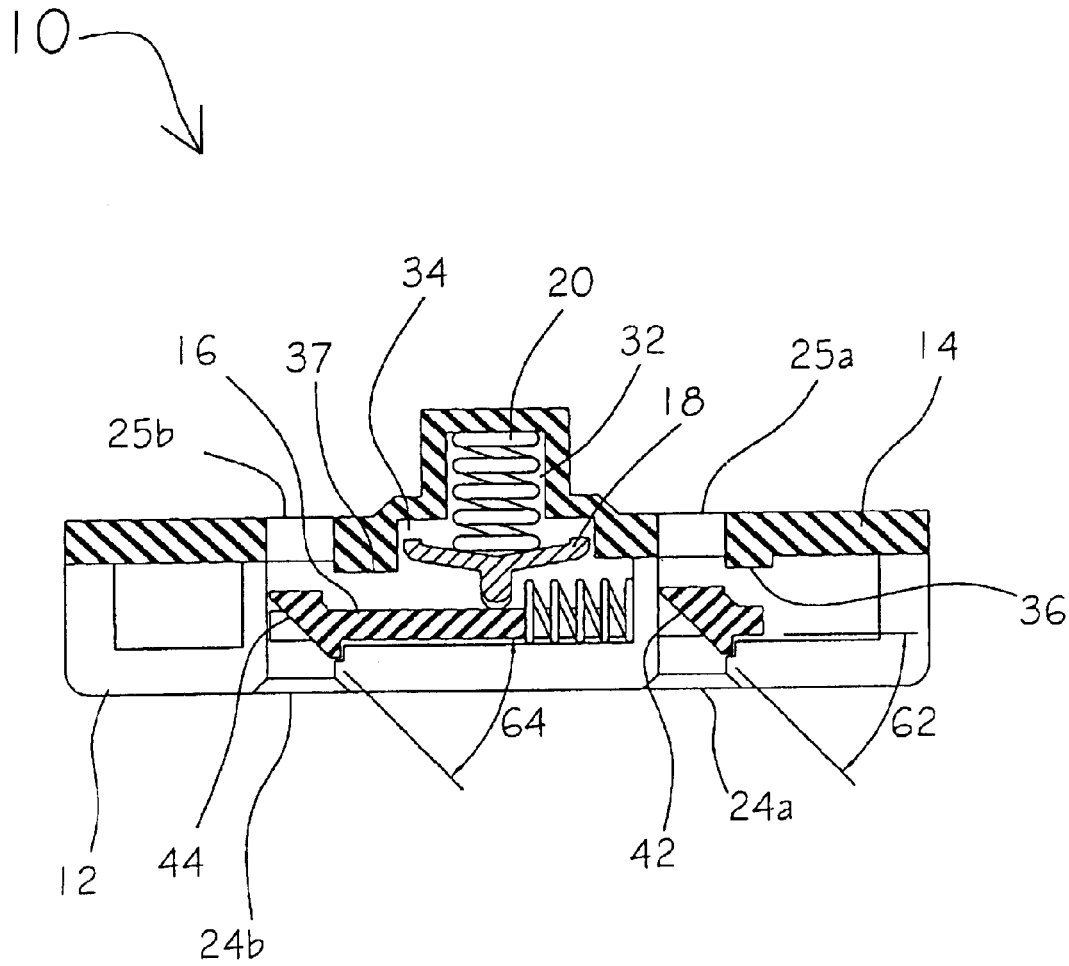
FIG. 11 shows the angles of the angled surfaces.

In FIG. 11, angle 62 shows the angle of angled surface 42 with respect to the front plate 12. Angle 64 shows the angle of angled surface 44 with respect to the front plate 12.

Figure 12:
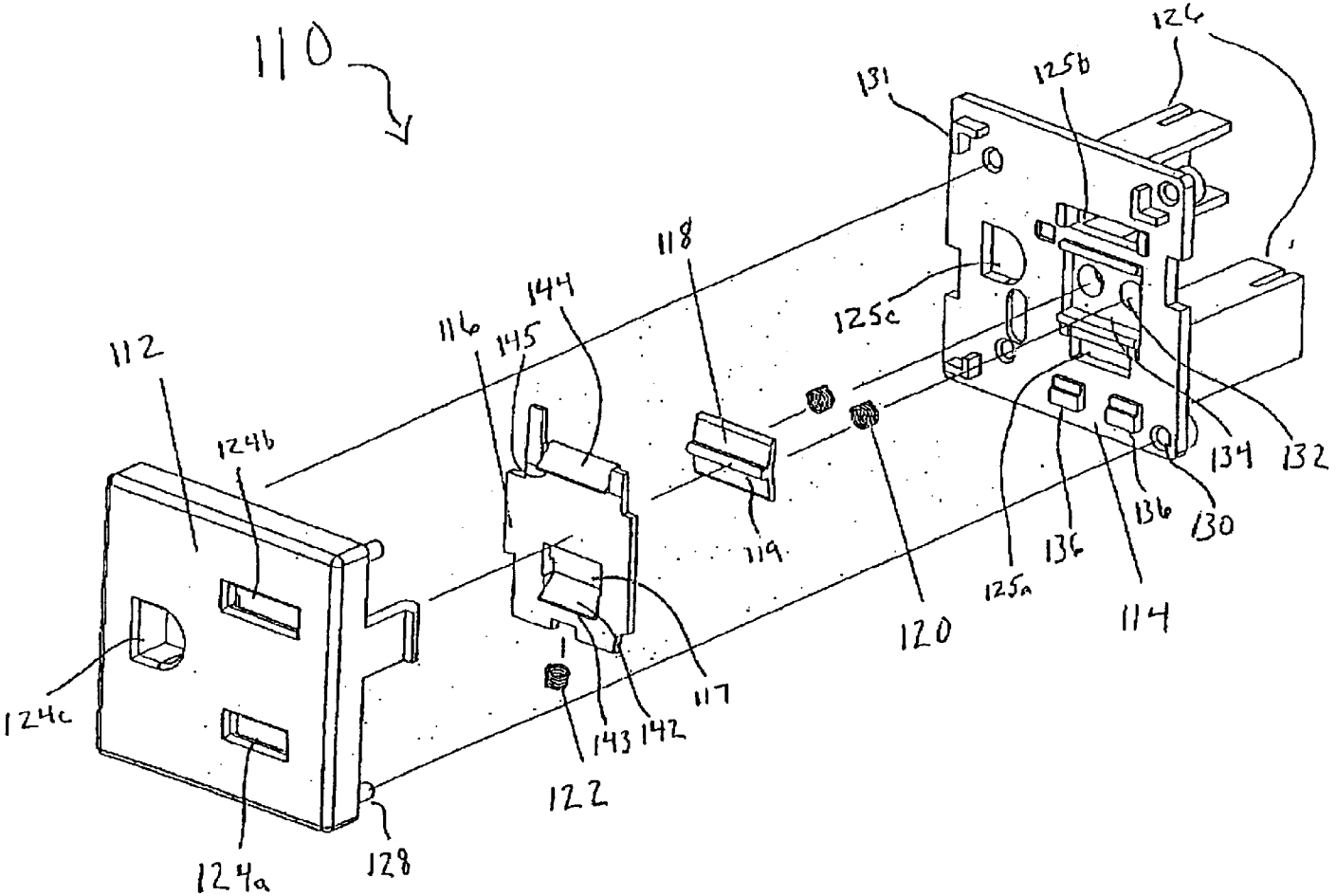
FIG. 12 shows a perspective view of a shutter assembly according to another embodiment of the present invention.

A shutter assembly 110 according to another embodiment of the present invention is shown in FIG. 12. The shutter assembly 110 includes a front plate 112, a back plate 114, a shutter 116, a plunger 118, one or more plunger springs 120 and a shutter spring 122. The shutter spring 122 may be disposed between a side of the shutter 116 and a side of the front plate 112. According to the embodiment of the present invention shown in FIG. 12, the shutter assembly 110 is used for a common household AC outlet.

According to the embodiment of the invention shown in FIG. 12, the front plate 112 includes front plate apertures 124*a*, 124*b* and 124*c*. The front plate apertures 124*a*, 124*b* and 124*c* shown in the embodiment of the invention of FIG. 12 are configured to accept a standard three-prong AC plug. However, embodiments of the invention may have front plate socket apertures configured in a variety of ways. For example, the front plate socket apertures may be configured to accept a standard two-prong AC plug, to conform to the characteristics of AC plugs in any country, or to accept the plugs of any type of cable used in a variety of industries. The front plate apertures may be configured to accept computer plugs, musical equipment plugs and the like.

The front plate 112 also includes one or more shafts 128 that may be useful in adjoining the front plate 112 with the back plate 114. In addition, the front plate 112 may include a variety of shafts, pins or brackets that may correspond to guides on the back plate 114, all of which may by used to maintain the position of the shutter 116 when the shutter 116 is disposed between the front plate 112 and the back plate 114.

According to another embodiment of the present invention, the back plate 114 includes back plate apertures 125*a*, 125*b* and 125*c*. The back plate apertures 125*a*, 125*b* and 125*c* of the embodiment of the invention shown in FIG. 12 align with the front plate apertures 124*a*, 124*b* and 124*c* and are also configured to conform to a standard three-prong AC plug. The back plate 114 also includes one or more shaft guides 130 that serve as a receptacle for the shafts 128 of the front plate 112 when adjoining the front plate 112 and the back plate 114. The back plate 114 may also include mounts 126 that aid in holding metal contacts behind a socket outlet. Brackets 131 may also be used for alignment when adjoining the front plate 112 to the back plate 114.

The back plate 114 may also include one or more plunger spring compartments 132 and a plunger compartment 134. The one or more plunger spring compartments 132 may be used to provide a place for disposing the one or more plunger springs 120. The plunger compartment 134 may be used to provide a place within the back plate 114 for disposing the plunger 118.

The back plate 114 may also include one or more back plate locks 136 that aid in securing the shutter when undesired, unwanted or improper access to the receptacle is attempted. The function of the back plate locks 136 will be explained in greater detail below.

The shutter assembly 110 may include a first angled surface 142 and a second angled surface 144. At one end of the first angled surface 142 is a first lug 143. Similarly, at one end of the second angled surface 144 is a second lug 145. In the embodiment of the invention shown in FIG. 12, the lugs 143 and 145 form an integral part of the first angled surface 142 and the second angled surface 144, respectively. However, the lugs 143 and 145 need not be so formed. The lugs 143 and 145 may be formed as another part of the shutter 116 or may be separate parts that are attached or affixed to the shutter 116.

The first angled surface 142 and the second angled surface 144 may be fabricated at a variety of angles. According to embodiments of the present invention, the angle of the first angled surface 142 and the second angled surface 144 may be greater than 45°. According to one embodiment of the present invention, the angle of the first angled surface and the second angled surface may be 47°. Angles of 45° or greater provide for minimal wear on the first angled surface 142 and the second angled surface 144 when pins or plugs are inserted into the shutter assembly 110 and up against the first angled surface 142 and the second angled surface 144.

The shutter 116 also includes at least one shutter aperture 117. The shutter aperture 117 may align with the first front plate aperture 124*a* and the first back plate aperture 125*a*, as will be explained in more detail below.

According to the embodiment of the invention shown in FIG. 12, the plunger 118 is exposed between the back plate 114 and the shutter 116. The plunger 118 may also include a ridge 119 for providing a pivot point to the shutter 116. The ridge 119 may be formed in a triangular shape, a rounded shape, or any shape what will allow the shutter 116 to pivot about the ridge 19 while the ridge 119 is forced against one side of the shutter 116 due to the force applied by the plunger spring 120, as will be explained in more detail below.

Operation of the shutter assembly 110 when access to the receptacle is desired may be seen in FIGS. 13–16. In the embodiment of the invention shown in FIG. 13, the front plate 112 is disposed adjacent to and abuts the back plate 114. Disposed in a hollow area between the front plate 112 and the back plate 114 is the shutter 116. The plunger spring 120 is disposed in the plunger spring compartment 132 and is configured such that it exerts a force against the plunger 118, which itself is disposed between the plunger spring 120 and the shutter 116. In turn, the ridge 119 of the plunger 118 exerts a force against the shutter 116 due to the force exerted by the plunger spring 120. When there are no pins present within the shutter assembly 110, there is no force external to the shutter assembly 110 acting on the shutter 116. Thus, the shutter 116 is disposed against the front plate 112 due to the force acting on it exerted by the plunger spring 120 through the plunger 118 and the ridge 119.

Figure 13:
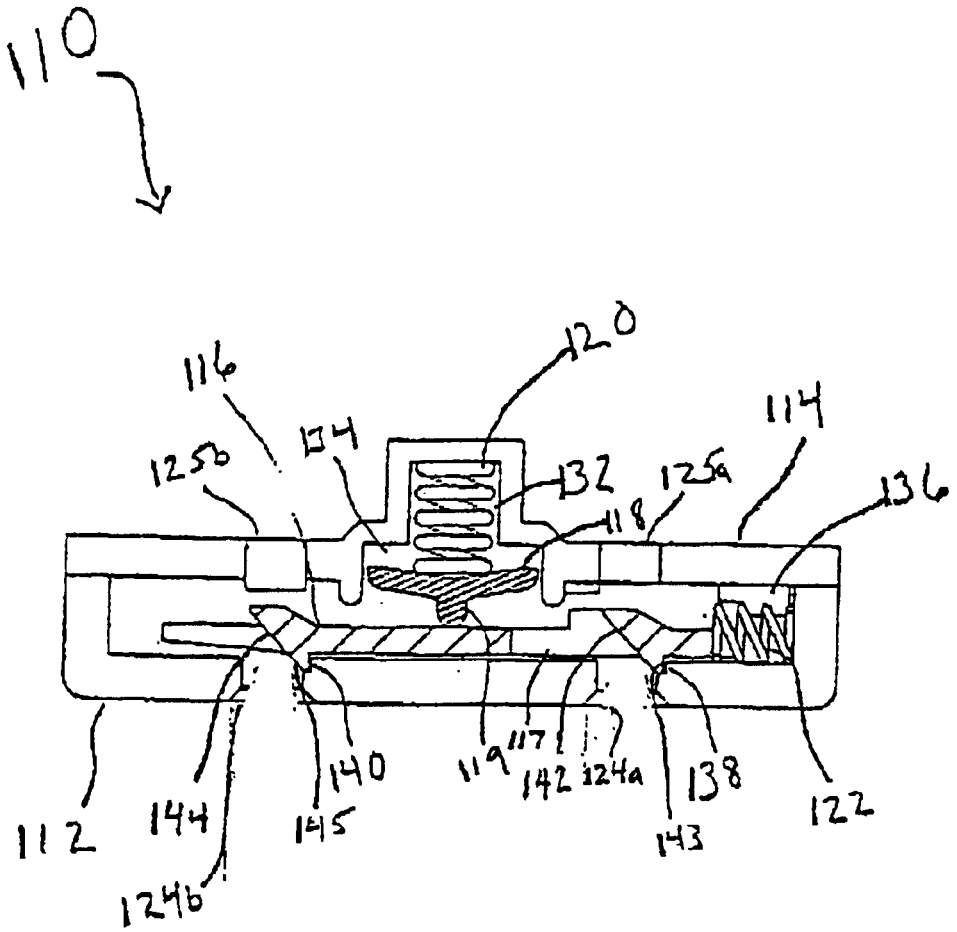
FIG. 13 shows a cutaway plan view of a shutter assembly according to another embodiment of the present invention.

When the shutter 116 is in the position shown in FIG. 13, the first lug 143 and the second lug 145 of the shutter 116 abut a first front plate lock 138 and a second front plate lock 140, respectively. The first front plate lock 138 and the second front plate lock 140 may be fabricated as an integral portion of the front plate 112. According to another embodiment of the present invention, the first front plate lock 138 and the second front plate lock 140 may be fabricated as separate parts that are affixed or otherwise attached to the front plate 112. As can be seen in FIG. 13, the first front plate lock 138 and the second front plate lock 140 provide resistance for the first lug 143 and the second lug 145, respectively, thereby preventing the shutter 116 from moving toward the shutter spring 122.

Figure 14:
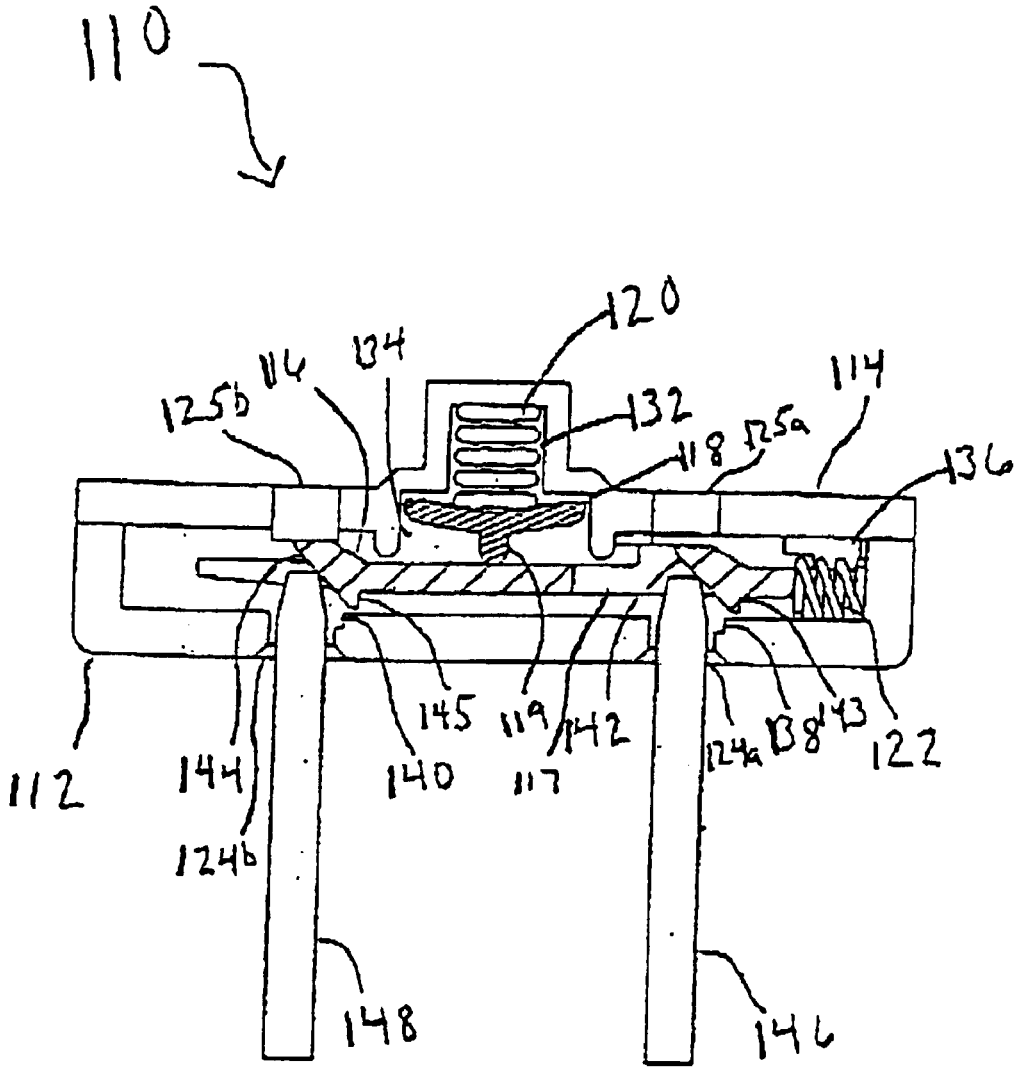
FIG. 14 shows a cutaway plan view of a shutter assembly with two pins inserted into the shutter assembly according to another embodiment of the present invention.

However, as can be seen in FIG. 14, if a substantially equal force is applied by a first pin 146 and a second pin 148, the first pin 146 and the second pin 148 will simultaneously push against the first angled surface 142 and the second angled surface 144, respectively. In so doing, the first lug 143 and the second lug 145 are pushed away from the first front plate lock 138 and the second front plate lock 140, respectively. When the positions of the first lug 143 and the second lug 145 are clear of the first front plate lock 138 and the second front plate lock 140, respectively, there is no resistance to the lateral movement of the shutter 116. Also, as the first pin 146 and the second pin 148 are inserted through the front plate apertures 124*a* and 124*b* and pushed against the first angled surface 142 and the second angled surface 144, respectively, the shutter 116, whose lateral movement is not inhibited by the first front plate lock 138 and the second front plate lock 140, moves toward the shutter spring 122 and, if adequate force is applied by the first pin 146 and the second pin 148, the compression of the shutter spring 122 increases.

Figure 15:
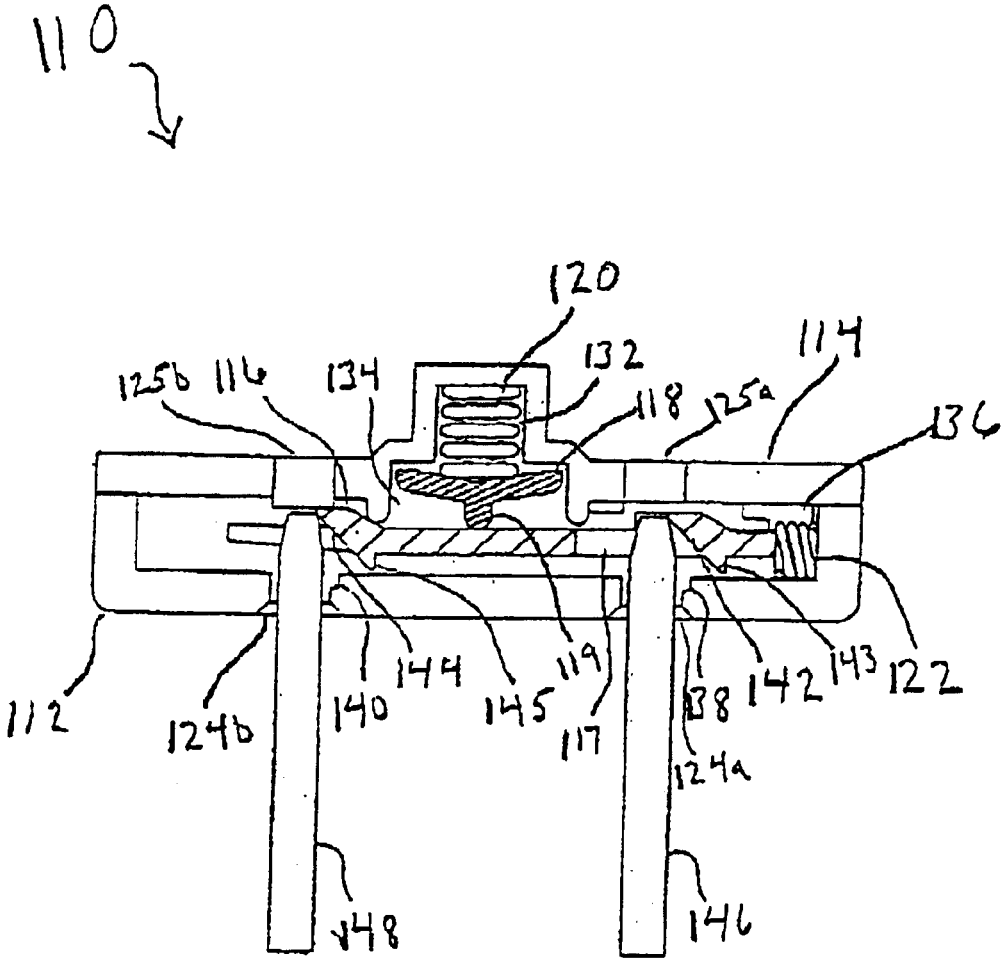
FIG. 15 shows a cutaway plan view of a shutter assembly with two pins inserted into the shutter assembly according to another embodiment of the present invention.
Figure 16:
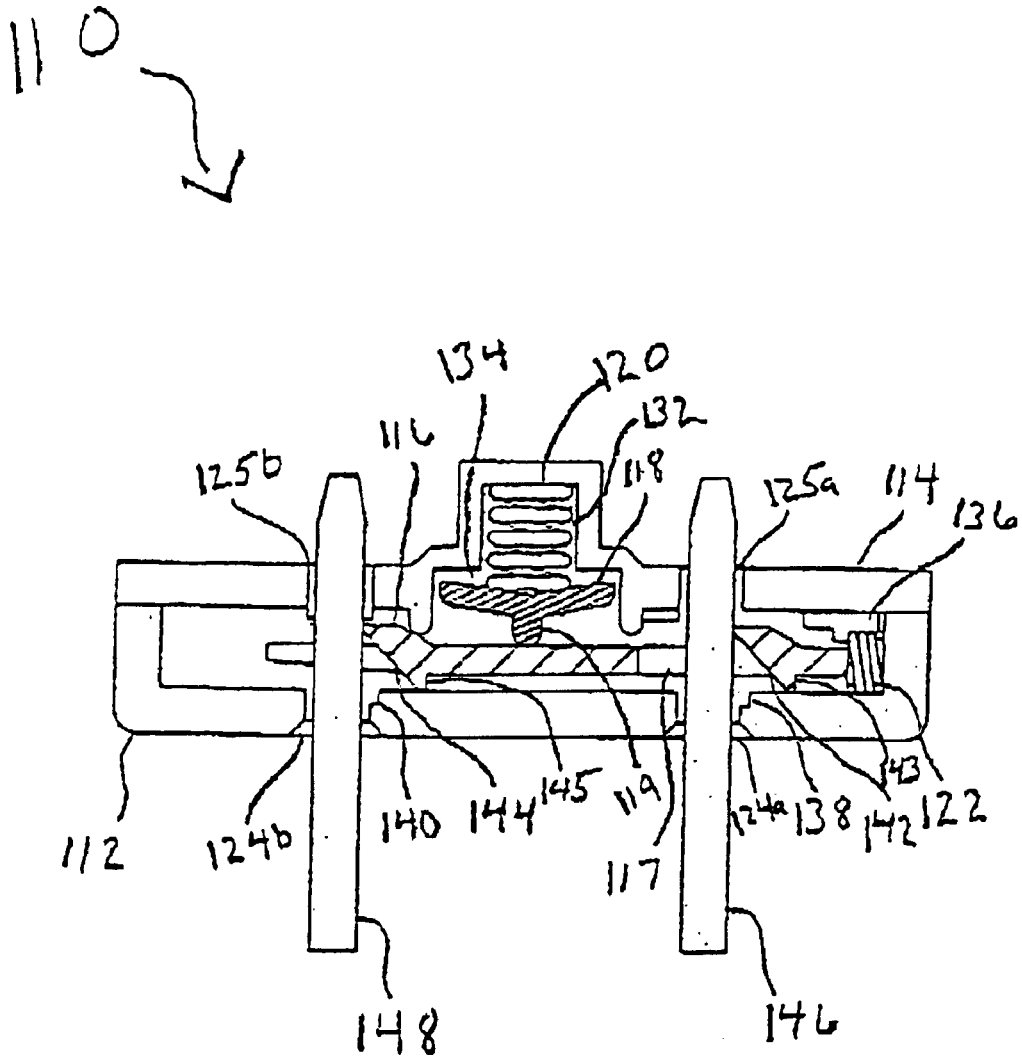
FIG. 16 shows a cutaway plan view of a shutter assembly with two pins inserted into the shutter assembly according to another embodiment of the present invention.

Moreover, as can be seen in FIG. 15, as the shutter 116 moves laterally toward the shutter spring 122, the shutter aperture 117 aligns itself with the first front plate aperture 124*a* and the first back plate aperture 125*a* and, simultaneously, the second front plate aperture 124*b* and the second back plate aperture 125*b* through which the second pin 148 is being inserted are exposed. Thus, the first pin 146 is free to extend fully through the first front plate aperture 124*a*, the shutter aperture 117 and the first back plate aperture 125*a*, as may be seen in FIG. 16. Also, the second pin 148 is free to extend fully through the second front plate aperture 124*b* and the second back plate aperture 125*b*. In FIG. 16, the shutter spring 122 is fully compressed. When the first pin 146 and the second pin 148 are simultaneously removed from the shutter assembly 110, the compression of the shutter spring 122 will force the shutter 116 back into its locked position as shown in FIG. 13.

Figure 17:
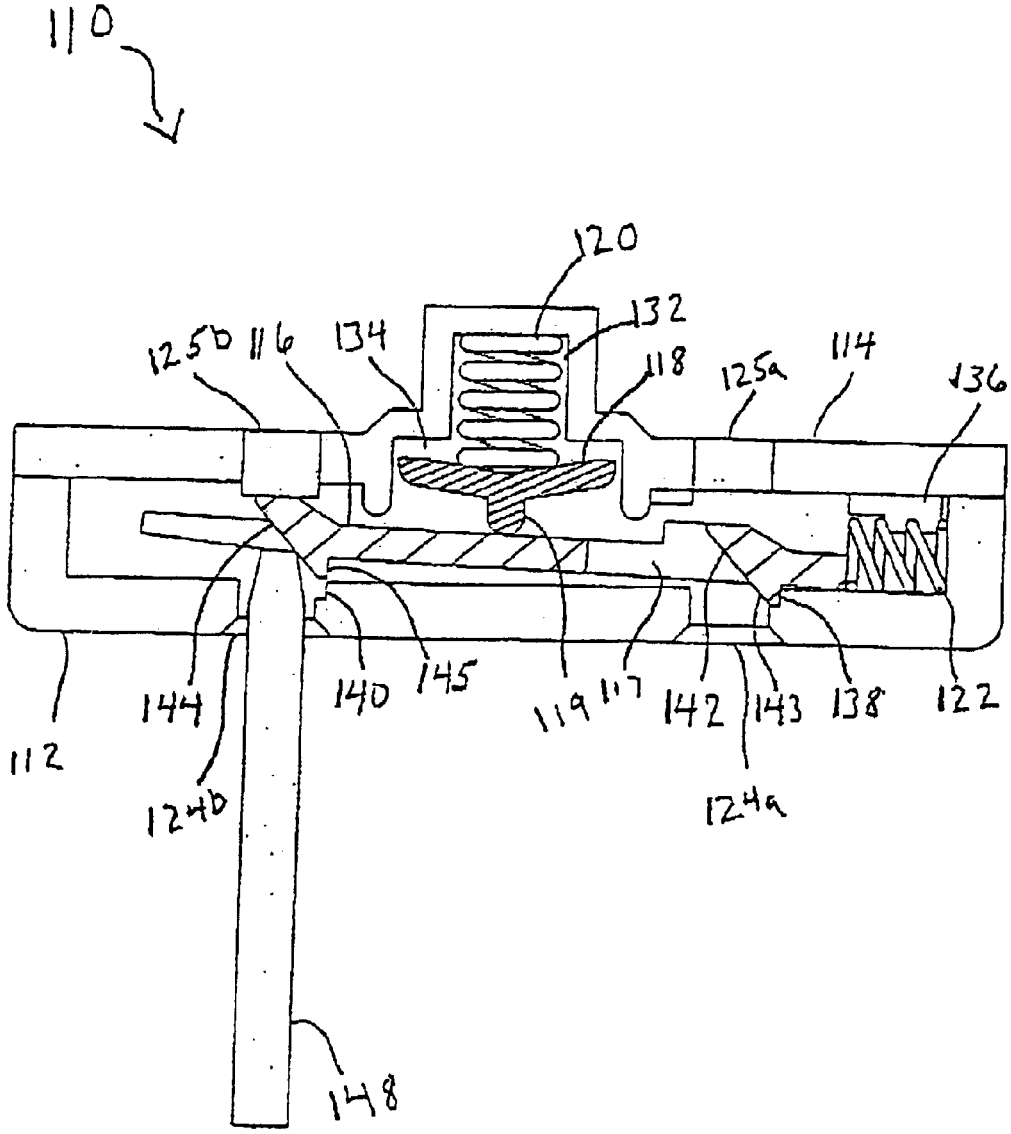
FIG. 17 shows a cutaway plan view of a shutter assembly with one pin inserted into the shutter assembly according to another embodiment of the present invention.

Operation of the shutter assembly 110 when entry into a receptacle is unwanted, undesired or improper may be seen in FIGS. 17, 18, 19, 20A, 20B, 21A and 21B. In FIG. 17, the second pin 148 only is inserted into the second front plate aperture 124*b*. This situation may be reminiscent, for example, of a child trying to stick a key or other object into one of the apertures of an AC outlet. In FIG. 17, as the second pin 148 extends through the second front plate aperture 124*b*, the force exerted by the second pin 148 on the second angled surface 144 causes the shutter 116 to pivot about the ridge 119. Thus, although the second lug 145 is forced away from the second plate lock 140, the first lug 143 is forced by the plunger to maintain its position against the first front plate lock 138. Thus, the shutter 116 is prevented from moving laterally toward the shutter spring 122, the first and second front plate apertures 124*a* and 124*b* are blocked by the shutter 116, and access to the first and second back plate apertures 125*a* and 125*b* and the receptacle itself is prevented.

Figure 18:
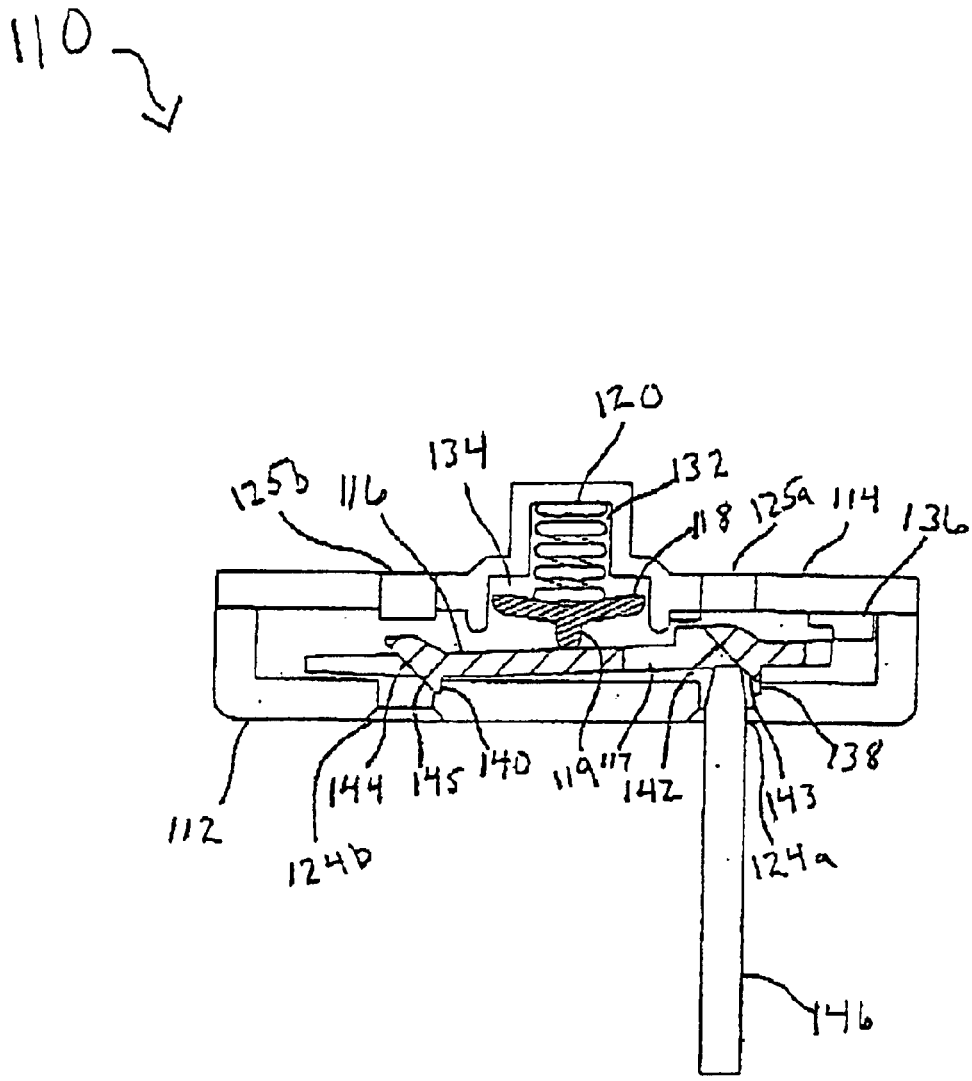
FIG. 18 shows a cutaway plan view of a shutter assembly with one pin inserted into the shutter assembly according to another embodiment of the present invention.

A similar operation may be seen in FIG. 18. In FIG. 18, the first pin 146 only is inserted into the first front plate aperture 124*a*. As the first pin 146 is forced against the first angled surface 142, the first lug 143 is pushed away from the first front plate lock 138. Simultaneously, however, the force exerted by the first pin 146 against the first angled surface 142 causes the shutter 116 to pivot about the ridge 119. This forces the second lug 145 to maintain its position against the second front plate lock 140. Accordingly, the shutter 116 is prevented from moving laterally toward the spring 122 (not shown in FIG. 18 for clarity).

Figure 19:
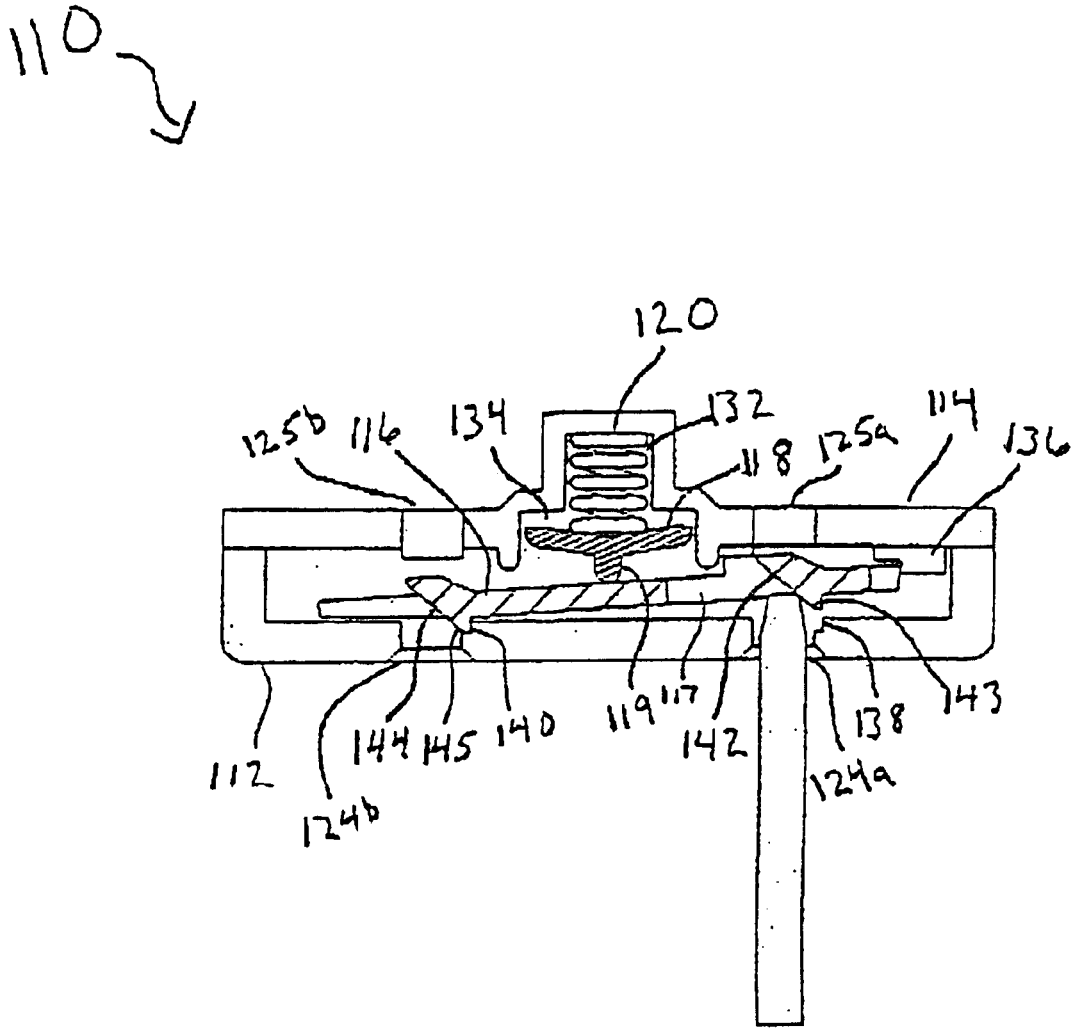
FIG. 19 shows a cutaway plan view of a shutter assembly with one pin inserted into the shutter assembly according to another embodiment of the present invention.

Another embodiment of the present invention may be seen in FIG. 19. According to the embodiment of the invention shown in FIG. 19, the back plate 114 includes a back plate lock 136. The back plate lock 136 provides additional protection against unwanted, undesired or improper access to the receptacle. Although in the embodiment shown in FIG. 19 includes a back plate lock 136 disposed on the back plate 114, the back plate lock 136 may be disposed on the front plate 112 or another portion of the device. Operation of the back plate lock 136 maybe seen in connection with FIGS. 18 and 19.

Figure 20A:
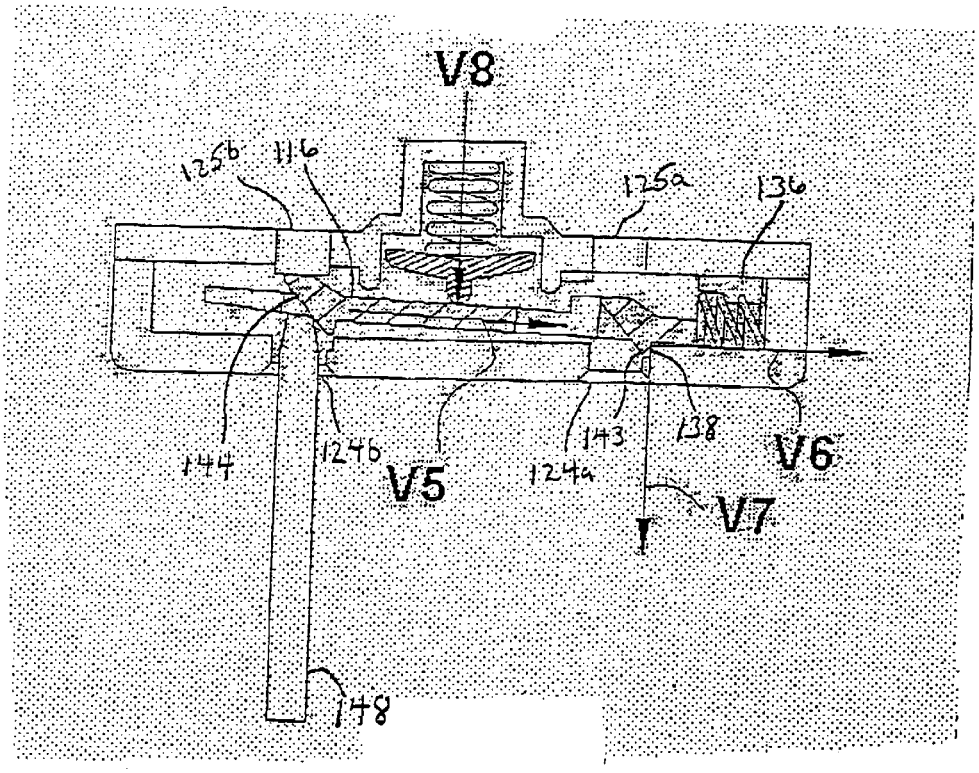
FIG. 20A shows a cutaway plan view of a shutter assembly with one pin inserted into the shutter assembly according to another embodiment of the present invention.
Figure 20B:
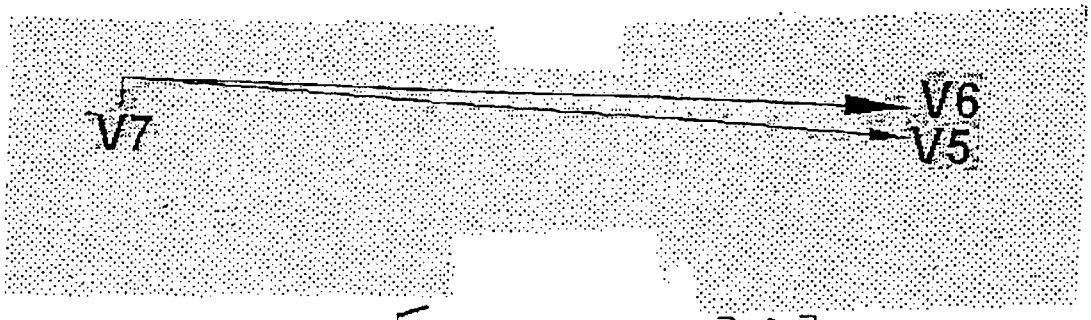
FIG. 20B shows a force diagram of the forces present in the embodiment of the invention shown in FIG. 20A.

FIGS. 20A and 20B show forces present when the shutter assembly 110 is operated in a manner as shown in FIG. 17.

When the second pin 148 is inserted through the second front plate aperture 124*b* and forced against the second angled surface 144, a force V5, shown in FIG. 20A, is generated. V5 may be expressed as V6+V7, as shown in FIG. 20B. A force V8 is generated by the plunger spring 120. All of the forces V6, V7 and V8 acting on the shutter 116 when the second pin 148 is inserted through the second front plate aperture 124*b* and forced against the second angled surface 144 force the first lug 143 to maintain its position against the first front plate lock 138. Thus, access to the receptacle is denied.

Figure 21A:
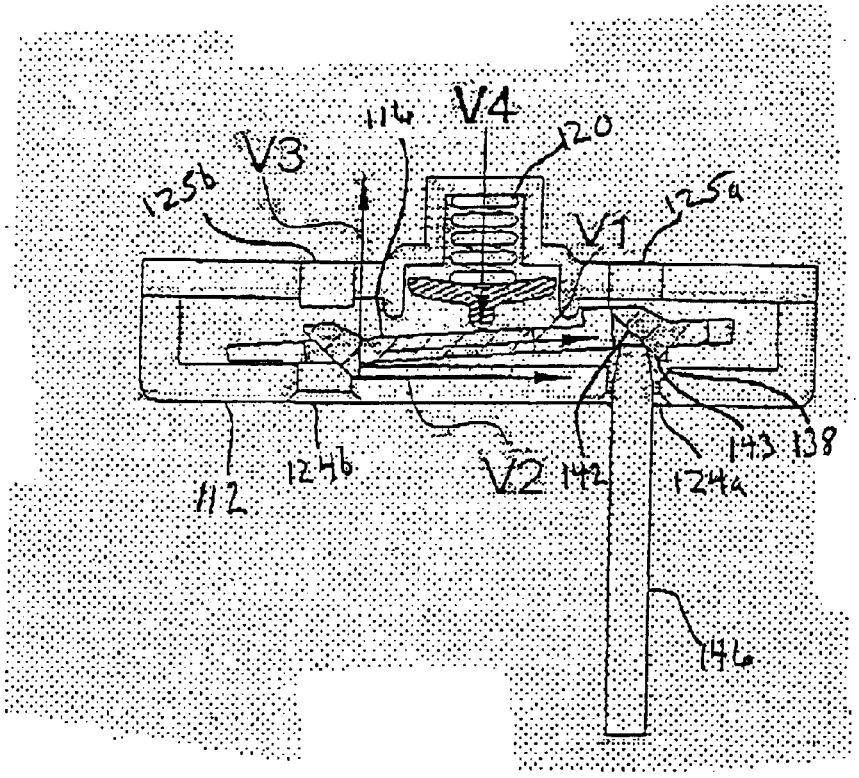
FIG. 21A shows a cutaway plan view of a shutter assembly with one pin inserted into the shutter assembly according to another embodiment of the present invention.
Figure 21B:
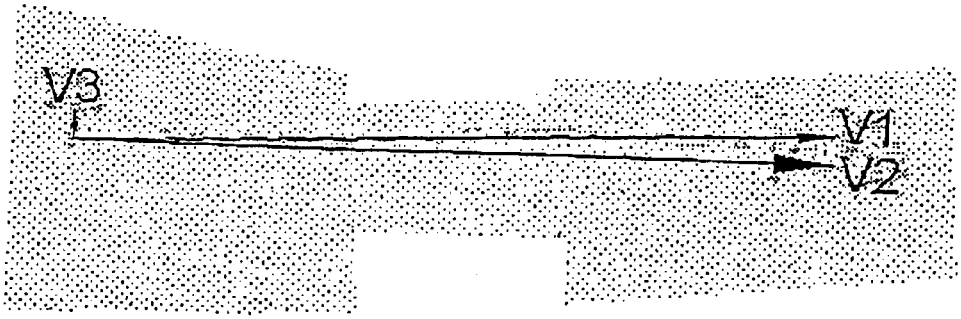
FIG. 21B shows a force diagram of the forces present in the embodiment of the invention shown in FIG. 21A.

FIGS. 21A and 21B show forces present when the shutter assembly 110 is operated in a manner as shown in FIGS. 18 and 19. When the first pin 146 is inserted into the first front plate aperture 124*a* and forced against the first angled surface 142, a force V1, shown in FIG. 21A, is generated. The force V1 may be expressed as V2+V3, as shown in FIG. 21B. A force V4 is generated by the plunger spring 120. The forces V2, V3 and V4 act on the shutter 116 when the first pin 146 is inserted into the first front plate aperture 124*a* and forced against the first angled surface 142.

However, as can be seen in FIG. 21B, the direction of V3 is opposite that of V4. Thus, if the force used to insert the first pin 146 against the first angled surface 142 is large enough such that V3 is great enough to overcome V4, the shutter 116 may be pushed away from the front plate 112, thereby precluding the second lug 145 from maintaining its position against the second front plate lock 140. Lateral movement of the shutter 116, therefore, may be possible. Accordingly, if the shutter 116 is pushed away from the front plate 112 when V3 is great enough to overcome V4, the back plate lock 136, as shown in FIGS. 18 and 19 (not shown in FIG. 21A for clarity), can provide resistance to the shutter 116 and prevent the shutter 116 from moving laterally and exposing the front plate apertures 124*a* and 124*b* and the back plate apertures 125*a* and 125*b*, thereby preventing access to the receptacle.

The advantages of embodiments of the present invention may readily be seen. Embodiments of the present invention provide important advantages over the prior art. For example, both lugs keep the shutter locked into position against the front plate via the force exerted on it by the plunger spring via the plunger. Thus, the shutter assembly is in a "normally locked" position when there are no pins inserted into the shutter assembly. In other words, the shutter of the present invention rests normally in a locked position. No insertion is required to engage the locks. According to embodiments of the present invention, the plunger may provide a consistent force to the shutter so that the lugs remain in a locked position against the front plate when the apertures of the shutter assembly are closed.

Another advantage of embodiments of the present invention is that the contact surfaces, which generates friction when the shutter slides, are very small as can be seen in FIG. 4. Thus, the friction between the shutter and the plunger and the friction between the shutter and the front plate are minimal as the shutter moves laterally. As a result of low friction and low insertion force, when two pins, other than the ground pin, either sharp or round edges, are inserted into the shutter assembly, the shutter slides laterally smoothly. The angled surfaces will not wear out quickly even when plugs with relatively sharp edges are inserted into the socket.

Moreover, the unique design of embodiments of the present invention results in a shutter assembly having a relatively small thickness. A small thickness is desirable in that the distance a properly inserted plug must travel through the assembly is minimized and contact between the plug and contact points on an opposite side of the assembly is unlikely compromised.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. A shutter assembly for a receptacle comprising:

a first plate, the first plate including a first plurality of apertures;

a second plate disposed adjacent the first plate, the second plate including a second plurality of apertures;

a shutter disposed between the first plate and the second plate, the shutter including an aperture;

a first spring for providing lateral movement to the shutter, the first spring disposed adjacent the shutter;

a second spring for providing axial movement to the shutter; and a plunger for providing a pivot point to the shutter, the plunger disposed between the second spring and the shutter, wherein the shutter is laterally moveable between a first position and a second position so that the aperture of the shutter aligns with at least one aperture of the first plurality of apertures and at least one aperture of the second plurality of apertures.

2. The shutter assembly of claim 1, wherein the receptacle is an AC outlet.

3. The shutter assembly of claim 1, wherein the first plurality of apertures and the second plurality of apertures are configured to accept pins.

4. The shutter assembly of claim 3, wherein the pins are AC plug pins.

5. The shutter assembly of claim 3, wherein the shutter comprises:

a first angled surface; and a second angled surface, and wherein the aperture is disposed between the first angled surface and the second angled surface.

6. The shutter assembly of claim 5, wherein in the first position of the shutter, the first angled surface is aligned with one aperture of the first plurality of apertures of the first plate and the second angled surface is aligned with another aperture of the first plurality of apertures of the first plate.

7. The shutter assembly of claim 6, wherein the first plate further comprises a first lock and a second lock and the second plate further comprises a third lock and a fourth lock.

8. The shutter assembly of claim 7, wherein the shutter further comprises a first lug, a second lug, a third lug and a fourth lug.

9. The shutter assembly of claim 8, wherein when the shutter is in the first position, the first lug abuts the first lock of the first plate and the second lug abuts the second lock of the first plate.

10. The shutter assembly of claim 5, wherein in the second position of the shutter, the aperture of the shutter aligns with one aperture of the first plurality of apertures of the first plate and one aperture of the second plurality of apertures of the second plate as pins are inserted through at least two appertures of the plurality of apertures of the first plate, the pins being simultaneously forced against the first angled surface and the second angled surface.

11. The shutter assembly of claim 10, wherein the shutter compresses the first spring when the shutter is in the second position.

12. The shutter assembly of claim 8, wherein the second spring causes the first lug and the second lug to abut the first lock and the second lock when the shutter is in the first position.

13. The shutter assembly of claim 8, wherein the shutter pivots about the plunger when one pin is inserted into one of the first plurality of apertures of the first plate.

14. The shutter assembly of claim 13, wherein the first lug abuts the first lock when the shutter pivots about the plunger.

15. The shutter assembly of claim 12, wherein the second lug abuts the second lock when the shutter pivots about the plunger.

16. The shutter assembly of claim 7, wherein the third lug of the shutter abuts the third lock when the shutter pivots about the plunger.

17. The shutter assembly of claim 7, wherein the fourth lug of the shutter abuts the fourth lock when the shutter pivots about the plunger.

18. The shutter assembly of claim 6, wherein the shutter blocks the first plurality of apertures of the first plate and the second plurality of apertures of the second plate when the shutter is in the first position.

19. The shutter assembly of claim 6, wherein the shutter remains in the first position when a pin is inserted through only one aperture of the first plurality of apertures of the first plate.

20. The shutter assembly of claim 1, wherein the second spring comprises two springs.

21. The shutter assembly of claim 7, wherein the first lock and the second lock are protrusions of the first plate.

22. The shutter assembly of claim 7, wherein the first lock and the second lock are attached to the first plate.

23. The shutter assembly of claim 7, wherein the third lock and the fourth lock are protrusions of the second plate.

24. The shutter assembly of claim 7, wherein the third lock and the fourth lock are attached to the second plate.

25. The shutter assembly of claim 1, wherein the second plate further comprises:

a first compartment for housing the plunger; and a second compartment for housing the second spring.

26. The shutter assembly of claim 1, wherein the first plate comprises a first extension and a second extension, the first extension and the second extension extending outwardly from the first plate.

27. The shutter assembly of claim 26, wherein the first spring is disposed between the first extension and the second extension.

28. The shutter assembly of claim 1, wherein the first spring is disposed between a side of the first plate and a side of the shutter.

29. The shutter assembly of claim 6, further comprising a first lock, a second lock and a third lock, the first lock, the second lock and the third lock disposed adjacent the shutter.

30. The shutter assembly of claim 29, wherein a portion of the shutter abuts the third lock when the shutter pivots about the plunger.

31. The shutter assembly of claim 29, wherein the third lock is a protrusion of the second plate.

32. The shutter assembly of claim 29, wherein the third lock is a protrusion of the first plate.

33. The shutter assembly of claim 29, wherein the third lock is attached to the second plate.

34. The shutter assembly of claim 29, wherein the third lock is attached to the first plate.

35. A method of manufacturing a shutter assembly for a receptacle comprising:

providing a first plate having a first plurality of apertures;

disposing a second plate adjacent the first plate, the second plate having a second plurality of apertures;

disposing a shutter between the first plate and the second plate, the shutter including an aperture;

abutting a first spring adjacent the shutter, the first spring providing lateral movement of the shutter;

providing a second spring for providing axial movement of the shutter; and disposing a plunger between the second spring and the shutter, the plunger providing a pivot point to the shutter, wherein the shutter is laterally moveable between a first position and a second position so that the aperture of the shutter aligns with at least one aperture of the first plurality of apertures and at least one aperture of the second plurality of apertures.

36. A shutter assembly for an AC outlet comprising:

a first plate;

a second plate disposed adjacent the first plate;

a shutter disposed between the first plate and the second plate, the shutter including an aperture;

a first spring for providing lateral movement to the shutter, the first spring disposed adjacent the shutter;

a second spring for providing axial movement to the shutter; and a plunger for providing a pivot point to the shutter, the plunger disposed between the second spring and the shutter, wherein the first plate and the second plate comprise a plurality of apertures for accepting AC plug pins, wherein in a first position of the shutter, the shutter assembly prevents AC plug pins from passing through the plurality of apertures in the first and second plates and the shutter aperture, wherein in a second position of the shutter, the shutter assembly permits AC plug pins to pass through the plurality of apertures in the first and second plates and the shutter aperture, and wherein the shutter is laterally moveable between a first position and a second position so that the aperture of the shutter aligns with at least one aperture of the first plurality of apertures and at least one aperture of the second plurality of apertures.

37. The method of claim 35, further comprising configuring the first plurality of apertures and the second plurality of apertures to accept pins.

38. The method of claim 37, wherein the pins are AC plug pins.

39. The method of claim 35, further comprising:

providing the shutter with at least one surface configured such that a lateral movement of the shutter caused by a force exerted on the at least one surface aligns the aperture of the shutter with at least one aperture of the first plurality of apertures and at least one aperture of the second plurality of apertures.

40. The method of claim 39, further comprising:

configuring the at least one surface with a first angled surface and a second angled surface; and disposing the aperture between the first angled surface and the second angled surface.

41. The method of claim 40, wherein in a first position of the shutter, the first angled surface is aligned with one aperture of the first plurality of apertures of the first plate and the second angled surface is aligned with another aperture of the first plurality of apertures of the first plate.

42. The method of claim 40, wherein in a second position of the shutter, the aperture of the shutter aligns with one aperture of the first plurality of apertures of the first plate and one aperture of the second plurality of apertures of the second plate as pins are inserted through at least two apertures of the first plurality of apertures of the first plate, the pins being simultaneously forced against the first angled surface and the second angled surface.

43. The shutter assembly of claim 1, wherein the shutter comprises at least one surface configured such that a lateral movement of the shutter caused by a force exerted on the at least one surface aligns the aperture of the shutter with at least one aperture of the first plurality of apertures and at least one aperture of the second plurality of apertures.

44. The shutter assembly of claim 43, wherein the shutter comprises a first surface and a second surface.

45. The shutter assembly of claim 43, wherein the first surface is angled and the second surface is angled.

46. The shutter assembly of claim 44, wherein the shutter moves laterally when a force is applied substantially simultaneously to the first surface and the second surface.

47. The shutter assembly of claim 44, wherein the shutter pivots about the plunger when a force is applied only to the first surface.

48. The shutter assembly of claim 44, wherein the shutter covers the first plurality of apertures and the second plurality of apertures when a force is applied only to the first surface.

49. The shutter assembly of claim 44, wherein the shutter pivots about the plunger when a force is applied only to the second surface.

50. The shutter assembly of claim 44, wherein the shutter covers the first plurality of apertures and the second plurality of apertures when a force is applied only to the first surface.

51. A shutter assembly comprising:

means for disposing a shutter between a first plate and a second plate, the first plate having a first plurality of apertures, the second plate having a second plurality of apertures, and the shutter having an aperture; and means for laterally moving the shutter upon exertion of a force on the shutter, wherein the shutter is laterally moveable between a first position and a second position so that the aperture of the shutter aligns with an aperture of the first plurality of apertures and an aperture of the second plurality of apertures when the shutter moves laterally.

* * * * *